US009685101B2

(12) United States Patent
van de Ven et al.

(10) Patent No.: US 9,685,101 B2
(45) Date of Patent: Jun. 20, 2017

(54) SOLID STATE LIGHT-EMITTING DEVICES WITH IMPROVED CONTRAST

(71) Applicant: Cree, Inc., Durham, NC (US)

(72) Inventors: Antony Paul van de Ven, Hong Kong (CN); Benjamin A. Jacobson, Chicago, IL (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/259,943

(22) Filed: Apr. 23, 2014

(65) Prior Publication Data

US 2015/0308634 A1 Oct. 29, 2015

(51) Int. Cl.
*F21K 99/00* (2016.01)
*G09F 9/33* (2006.01)

(52) U.S. Cl.
CPC ..... *G09F 9/33* (2013.01)

(58) Field of Classification Search
CPC ..... H01L 2224/48137; H01L 25/0753; H01L 33/504; G09F 9/33
USPC ..... 362/84
See application file for complete search history.

(56) References Cited

U.S. PATENT DOCUMENTS

| | | | |
|---|---|---|---|
| 6,600,175 | B1 | 7/2003 | Baretz et al. |
| 6,939,188 | B2 | 9/2005 | Katayama et al. |
| 6,940,101 | B2 | 9/2005 | Yano et al. |
| 7,791,061 | B2 | 9/2010 | Edmond et al. |
| 7,875,897 | B2 | 1/2011 | Suehiro |
| 7,937,865 | B2 | 5/2011 | Li et al. |
| 8,258,722 | B2 | 9/2012 | Swoboda et al. |
| 2005/0275937 | A1 | 12/2005 | Wu et al. |
| 2006/0071589 | A1 | 4/2006 | Radkov |
| 2006/0221272 | A1 | 10/2006 | Negley et al. |
| 2007/0240346 | A1 | 10/2007 | Li et al. |
| 2007/0241657 | A1 | 10/2007 | Radkov et al. |
| 2008/0173884 | A1 | 7/2008 | Chitnis et al. |
| 2008/0179611 | A1 | 7/2008 | Chitnis et al. |
| 2008/0258130 | A1 | 10/2008 | Bergmann et al. |
| 2008/0284316 | A1* | 11/2008 | Kurihara et al. ..... 313/503 |

(Continued)

FOREIGN PATENT DOCUMENTS

WO 2013102302 A1 7/2013

OTHER PUBLICATIONS

U.S. Appl. No. 14/259,890, filed Apr. 23, 2014.

(Continued)

*Primary Examiner* — Marcos D Pizarro
(74) *Attorney, Agent, or Firm* — Withrow & Terranova, P.L.L.C.; Vincent K. Gustafson

(57) ABSTRACT

Solid state light emitting devices and display devices include at least one filtering material arranged to provide at least one spectral notch comprising a wavelength of greatest attenuation in at least one spectrum between dominant wavelengths of solid state light emitters of the light emitting and/or display devices. The at least one spectral notch may be non-overlapping with a majority or an entirety of spectral output of each solid state light emitter. Filtering material may be arranged in a light path between at least some emitters and) at least one light output surface of a light emitting or display device, with the filtering material(s) arranged to receive incident ambient light, such that at least a portion of reflected ambient light exiting the device exhibits at least one spectral notch.

37 Claims, 9 Drawing Sheets

(56) References Cited

U.S. PATENT DOCUMENTS

| | | | | |
|---|---|---|---|---|
| 2009/0184616 | A1 | 7/2009 | Van De Ven et al. | |
| 2010/0328925 | A1 | 12/2010 | Hoelen et al. | |
| 2011/0170037 | A1* | 7/2011 | Nirmal et al. | 349/68 |
| 2011/0299284 | A1 | 12/2011 | Van De Ven et al. | |
| 2012/0306355 | A1 | 12/2012 | Seibel, II | |
| 2013/0170199 | A1 | 7/2013 | Athalye et al. | |
| 2014/0191653 | A1 | 7/2014 | Edmond et al. | |
| 2014/0346545 | A1 | 11/2014 | Chan et al. | |

OTHER PUBLICATIONS

Author Unknown, "69204—LED11DA19RVL/TP: GE LED A19 Features & Photos," GE Lighting Product Catalog for consumers, retrieved Jan. 20, 2015 from http://genet.gelighting.com/LightProducts/Dispatcher?REQUEST=CONSUMERSPECPAGE&PRODUCTCODE=69204, 1 page.

Author Unknown, "69204—LED11DA19RVL/TP: GE LED A19 Technical Specifications," GE Lighting Product Catalog for consumers, retrieved Jan. 20, 2015 from http://genet.gelighting.com/LightProducts/Dispatcher?REQUEST=CONSUMERSPECPAGE&PRODUCTCODE=69204&TABID=2&BreadCrumbValues=&ModelSelectionFilter=, 1 page.

Author Unknown, "CALiPER Retail Lamps Study 3," Solid-State Lighting Program, Feb. 2014, Pacific Northwest National Laboratory, U.S. Department of Energy, 48 pages.

Author Unknown, "LEDnovation EnhanceLite A19 LED Light Bulb Review," LED Light Review, retrieved Jan. 22, 2015 from http://led-light-review.com/reviews/lednovation-enhancelite-a19/, 5 pages.

Author Unknown, "Technical Note: Demonstration of Narrowband-notch and Multinotch Filters," JDS Uniphase Corporation, 2013, 16 pages.

* cited by examiner

SOLID STATE LIGHT-EMITTING DEVICES WITH IMPROVED CONTRAST

TECHNICAL FIELD

Subject matter herein relates to solid state light-emitting devices, including light emitting diode (LED) devices with reduced reflection of ambient light, and relates to LED displays including such devices.

BACKGROUND

Large format multi-color sequentially illuminated LED displays (including full color LED video screens) have become available in recent years and are now in common use. LED displays typically include numerous individual LED panels providing image resolution determined by the distance between adjacent pixels or "pixel pitch." Conventional LED displays include "RGB" three-color displays with arrayed red, green and blue emitters, and "RG" two-color displays include arrayed red and green emitters. Other colors and combinations of colors may be used.

Outdoor displays intended for viewing from great distances typically have relatively large pixel pitches and usually include discrete LED arrays. A LED array useable with an outdoor display may include a cluster of red, green, and blue LEDs that may be independently operated to form what appears to be viewer to be a full color pixel. Indoor displays may require shorter pixel pitches (e.g., 3 mm or less) and typically include panels with red, green, and blue LEDs mounted on a single electronic device attached to a driver printed circuit board (PCB) that controls the LEDs.

It is known to enclose an LED chip in a package to provide environmental and/or mechanical protection, color selection, light focusing and other functions. A LED package also includes electrical leads, contacts, and/or traces for electrically connecting the LED package to an external circuit. A conventional two-pin LED package/component 10 is illustrated in FIG. 1, including a single LED chip 12 mounted on a reflective cup 13 with a solder bond or epoxy (which may be conductive). One or more wire bonds 11 may connect the ohmic contacts of the LED chip 12 to leads 15A and/or 15B, which may be attached to or integral with the reflective cup 13. The LED package illustrated in FIG. 1 may include a vertically oriented LED chip 12 with a conductive growth substrate (p-side up in a group III-nitride LED) or conductive carrier substrate (n-side up) and one wire bond 11. In alternative implementations, a LED component may include a laterally oriented LED chip on an insulating substrate with two wire bonds. In other implementations involving use of one or more "flip" chips, the need for wire bonds may be eliminated. A transparent encapsulant material 16 may be provided in the reflective cup 13. A wavelength conversion material, such as a phosphor or other lumiphoric material, may be mixed with the encapsulant or otherwise arranged over the LED chip 12. Light emitted by the LED at a first wavelength may be absorbed by the wavelength conversion material, which may responsively emit light at a second wavelength. The assembly can be further covered with a clear protective resin 14, which may be molded in the shape of a lens to direct or shape the light emitted from the LED chip 12 and/or wavelength conversion material.

Another conventional LED package 20 is illustrated in FIG. 2, with the package 20 being suitable for high power operations with increased thermal dissipation requirements. In the LED package 20, one or more LED chips 22 are mounted over a carrier such as a printed circuit board (PCB) carrier, substrate or submount 23, which may include ceramic material. The package 20 may include one or more LED chips 22 of any suitable spectral output (e.g., ultraviolet, blue, green, red, white (e.g., blue LED chip arranged to stimulate emissions of phosphor material) and/or other colors). A reflector 24 may be mounted on the submount 23 (e.g., with solder or epoxy) to surround the LED chip(s) 22, reflect light emitted by the LED chips 22 away from the package 20, and also provide mechanical protection to the LED chips 22. One or more wirebond connections 21 may be made between ohmic contacts on the LED chips 22 and electrical traces 25A, 25B on the submount 23. The LED chips 22 are covered with a transparent encapsulant 26, which may provide environmental and mechanical protection to the chips while also acting as a lens.

Conventional LED components or packages such as shown in FIGS. 1 and 2 may include transparent encapsulant covering LED chips and reflector cups to minimize absorption of emitted light, and thereby ensure maximum light extraction. When used in LED displays, however, the reflective cups in conventional LED packages can reflect significant amounts of ambient light (e.g., sunlight incident on a LED display), which may impair viewing of images and/or text represented on the display. A conventional way to improve contrast is to position a neutral gray filter between a reflector associated with a display device and a light output surface of the device, thereby attenuating reflected ambient light nearly twice as much as direct emitted light (since ambient light incident on the display is attenuated once following passage in an incoming direction through the filter and is attenuated again after reflection following passage in an outgoing direction through the filter, whereas direct emitted light is attenuated only once upon passage in an outgoing direction through the filter.) This conventional neutral gray filtering, however, also reduces output of the direct emitted light, thereby requiring increased power and increased thermal dissipation to operate solid state emitters in order to achieve a desired level of display brightness. The art continues to seek improved LED devices and displays with reduced reflection of incident light and with enhanced contrast while overcoming limitations associated with conventional devices.

SUMMARY

The present disclosure relates in various aspects to solid state light emitting devices and display devices that include at least one filtering material arranged to provide at least one spectral notch comprising a wavelength of greatest attenuation in at least one spectrum between dominant wavelengths of solid state light emitters of the light emitting and/or display devices. Notch filtering materials may include, e.g., rare earth materials (including oxides thereof) and/or color pigments. In certain embodiments, the at least one spectral notch is non-overlapping with a majority or an entirety of spectral output of each solid state light emitter. In certain embodiments, at least one filtering material may be arranged in a light path between (i) at least some solid state light emitters of the plurality of electrically activated solid state light emitters and (ii) at least one light output surface of a light emitting or display device, wherein the at least one filtering material is arranged to receive ambient light incident on the light emitting or display device, such that at least a portion of reflected ambient light exiting the light emitting device or display device exhibits at least one spectral notch. In certain embodiments, at least one filtering material may be arranged on or over a reflector associated with a light emitting or display device. Since the majority or entirety of the notch filtered spectrum is non-coincident with spectral output of emitters associated with the lighting or display device, the notch filtering material(s) preferably attenuate the emitted light to an insignificant extent, but significantly attenuate incident light that is reflected from the lighting or display device. The relative lack of attenuation of emitted light represents a significant improvement over conventional use of neutral gray filters with display devices.

Although it is known to apply at least one notch filtering material to a light bulb (for example, by addition of a neodymium-based coating to incandescent light bulbs sold by General Electric under the brand name REVEAL®), such filtering materials have been applied to generate a spectral notch that corresponds to a portion of light emitted by the bulb in order to filter the light emissions. Subject matter disclosed herein represents a departure from conventional notch filtered light bulbs in that embodiments of the present disclosure provide at least one spectral notch that is non-overlapping with a majority or an entirety of spectral output of each solid state light emitter, with the intention of notch filtering ambient light without notch filtering (or without significantly notch filtering) emissions generated by the light emitting or display device. In certain embodiments, at least one notch filtering material may serve to attenuate intensity of aggregate emissions output by the display device by preferably less than 15%, less than 10%, less than 7.5%, or less than 5%.

In one aspect, the present disclosure relates to a display device adapted to display at least one of text and visual images, the display device comprising: a plurality of electrically activated solid state light emitters including a first group of solid state emitters arranged to generate emissions having a first dominant wavelength and a second group of solid state emitters arranged to generate emissions having a second dominant wavelength that differs from the first dominant wavelength by at least 50 nm; and at least one filtering material arranged in a light path between (i) at least some solid state light emitters of the plurality of electrically activated solid state light emitters and (ii) at least one light output surface of the display device, wherein the at least one filtering material is arranged to receive ambient light incident on the display device such that at least a portion of reflected ambient light exiting the display device exhibits a first spectral notch, wherein the first spectral notch comprises a wavelength of greatest attenuation in a spectrum between the first dominant wavelength and the second dominant wavelength.

In another aspect, the present disclosure relates to a display device adapted to display at least one of text and visual images, the display device comprising: a plurality of electrically activated solid state light emitters including at least one first solid state light emitter comprising a first dominant wavelength in a range of from 441 nm to 495 nm, at least one second solid state light emitter comprising a second dominant wavelength in a range of from 496 nm to 570 nm, and at least one third solid state light emitter comprising a third dominant wavelength in a range of from 591 nm to 750 nm; a first filtering material arranged in a light path between at least some solid state light emitters of the plurality of electrically activated solid state light emitters and at least one light output surface of the display device, wherein the first filtering material is arranged to receive ambient light incident on the display device such that at least a portion of reflected ambient light exhibits a first spectral notch, wherein the first spectral notch comprises a first wavelength of greatest attenuation in a spectrum between the first dominant wavelength and the second dominant wavelength; and a second filtering material arranged in a light path between at least some solid state light emitters of the plurality of electrically activated solid state light emitters and at least one light output surface of the display device, wherein the second filtering material is arranged to receive ambient light incident on the display device such that at least a portion of reflected ambient light exhibits a second spectral notch, wherein the second spectral notch comprises a second wavelength of greatest attenuation in a spectrum between the second dominant wavelength and the third dominant wavelength.

In yet another aspect, the present disclosure relates to a solid state light emitting device comprising: a plurality of electrically activated solid state light emitters including at least one first solid state light emitter arranged to generate emissions comprising a first dominant wavelength, at least one second solid state light emitter arranged to generate emissions comprising a second dominant wavelength, and at least one third solid state light emitter arranged to generate emissions comprising a third dominant wavelength; a first filtering material arranged in a light path between at least some solid state light emitters of the plurality of electrically activated solid state light emitters and at least one light output surface of the solid state lighting device, wherein the first filtering material is arranged to receive ambient light incident on the solid state lighting device such that at least a portion of reflected ambient light exhibits a first spectral notch, wherein the first spectral notch comprises a first wavelength of greatest attenuation in a spectrum between the first dominant wavelength and the second dominant wavelength; and a second filtering material arranged in a light path between at least some solid state light emitters of the plurality of electrically activated solid state light emitters and at least one light output surface of the solid state lighting device, wherein the second filtering material is arranged to receive ambient light incident on the solid state lighting device such that at least a portion of reflected ambient light exhibits a second spectral notch, wherein the second spectral notch comprises a second wavelength of greatest attenuation in a spectrum between the second dominant wavelength and the third dominant wavelength.

In still another aspect, the present disclosure relates to a solid state light emitting device comprising: a plurality of electrically activated solid state light emitters including at least one first solid state light emitter arranged to generate emissions comprising a first dominant wavelength, and at least one second solid state light emitter arranged to generate emissions comprising a second dominant wavelength; and at least one filtering material arranged in a light path between at least some solid state light emitters of the plurality of electrically activated solid state light emitters and at least one light output surface of the solid state lighting device, wherein the least one filtering material is arranged to receive ambient light incident on the solid state lighting device such that at least a portion of reflected ambient light exhibits a first spectral notch, wherein the first spectral notch comprises a wavelength of greatest attenuation in a spectrum between the first dominant wavelength and the second dominant wavelength.

In another aspect, the present disclosure relates to a display device including a plurality of solid state light emitting devices as described herein.

In another aspect, the present disclosure relates to a method of displaying at least one of text and visual images using a display device as described herein.

In another aspect, the present disclosure relates to a method comprising illuminating an object, a space, or an environment, utilizing a solid state lighting device as described herein.

In another aspect, any of the foregoing aspects, and/or various separate aspects and features as described herein, may be combined for additional advantage. Any of the various features and elements as disclosed herein may be combined with one or more other disclosed features and elements unless indicated to the contrary herein.

Other aspects, features and embodiments of the present disclosure will be more fully apparent from the ensuing disclosure and appended claims.

DETAILED DESCRIPTION

Figure 1:
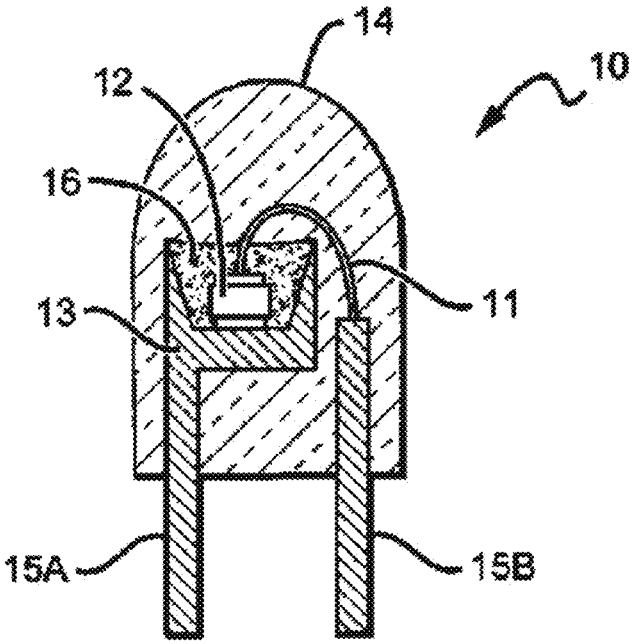
FIG. 1 (RELATED ART)
FIG. 1 is a side cross-sectional view of a first conventional light emitting diode package.
Figure 2:
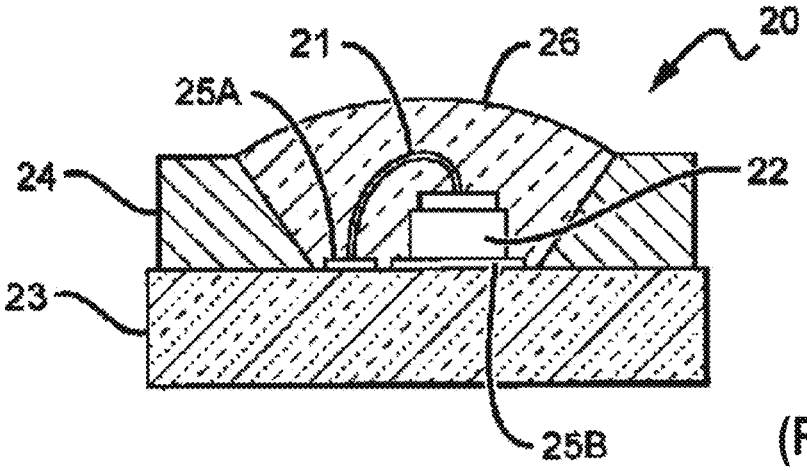
FIG. 2 (RELATED ART)
FIG. 2 is a side cross-sectional view of a second conventional light emitting diode package.

As noted previously, the art continues to seek improved LED devices and displays with reduced reflection of incident light and with enhanced contrast. Aspects of the present disclosure relate to solid state light emitting devices and display devices that include at least one filtering material arranged to provide at least one spectral notch in at least one spectrum between dominant wavelengths of solid state light emitters thereof. At least one filtering material may be provided on or over a reflector, and/or on or over at least one solid state light emitter. At least one filtering material may be provided in a light path between at least some solid state light emitters and at least one light output surface of the light emitting or display device, and arranged to filter ambient light so that reflected ambient light exhibits at least one spectral notch. The at least one spectral notch preferably includes a wavelength of greatest attenuation in a spectrum between dominant wavelengths of the solid state light emitters. This wavelength of greatest attenuation may or may not correspond to a center wavelength of the spectral notch. Preferably, the at least one spectral notch (e.g., at least wavelength spectrum corresponding to full width at half maximum (FWHM) attenuation) is non-overlapping with a majority or an entirety of spectral output of each solid state light emitter. Since the majority or entirety of the notch filtered spectrum is non-coincident with spectral output of emitters associated with the lighting or display device, the notch filtering material(s) preferably attenuate the emitted light to an insignificant extent, but significantly attenuate incident light that is reflected from the lighting or display device, thereby permitting improved contrast when a light emitting or display device is operated in an environment with presence of high levels of ambient light. Additionally, the relative lack of attenuation of emitted light represents a significant improvement over conventional use of neutral gray filters with display devices.

Unless otherwise defined, terms used herein should be construed to have the same meaning as commonly understood by one of ordinary skill in the art to which this present disclosure belongs. It will be further understood that terms used herein should be interpreted as having a meaning that is consistent with their meaning in the context of this specification and the relevant art, and should not be interpreted in an idealized or overly formal sense unless expressly so defined herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

Embodiments of the present disclosure are described herein with reference to cross-sectional, perspective, elevation, and/or plan view illustrations that are schematic illustrations of idealized embodiments of the present disclosure. Variations from the shapes of the illustrations as a result, for example, of manufacturing techniques and/or tolerances, are to be expected, such that embodiments of the present disclosure should not be construed as limited to particular shapes illustrated herein. The present disclosure may be embodied in different forms and should not be construed as limited to the specific embodiments set forth herein. In the drawings, the size and relative sizes of layers and regions may be exaggerated for clarity. In certain drawings, conventional features inherent to LED devices known in the art but not essential to the understanding of the present disclosure have been omitted to facilitate ease of explanation of the inventive subject matter.

Unless the absence of one or more elements is specifically recited, the terms "comprising," "including," and "having" as used herein should be interpreted as open-ended terms that do not preclude the presence of one or more elements.

It will be understood that when an element such as a layer, region, or substrate is referred to as being "on" another element, it can be directly on the other element or intervening elements may be present. Moreover, relative terms such as "on", "above", "upper", "top", "lower", or "bottom" may be used herein to describe a relationship between one structure or portion to another structure or portion as illustrated in the figures, but it should be understood that such relative terms are intended to encompass different orientations of the device in addition to the orientation depicted in the figures. For example, if the device in the figures is turned over, structure or portion described as "above" other structures or portions would now be oriented "below" the other structures or portions.

The terms "solid state light emitter" or "solid state emitter" (which may be qualified as being "electrically activated") may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials.

Solid state light emitting devices according to embodiments of the present disclosure may include, but are not limited to, III-V nitride based LED chips or laser chips fabricated on a silicon, silicon carbide, sapphire, or III-V nitride growth substrate, including (for example) devices manufactured and sold by Cree, Inc. of Durham, N.C. Such LEDs and/or lasers may optionally be configured to operate such that light emission occurs through the substrate in a so-called "flip chip" orientation. Such LED and/or laser chips may also be devoid of growth substrates (e.g., following growth substrate removal).

LED chips useable with lighting devices as disclosed herein may include horizontal devices (with both electrical contacts on a same side of the LED) and/or vertical devices (with electrical contacts on opposite sides of the LED). A horizontal device (with or without the growth substrate), for example, may be flip chip bonded (e.g., using solder) to a carrier substrate or printed circuit board (PCB), or wire bonded. A vertical device (without or without the growth substrate) may have a first terminal solder bonded to a carrier substrate, mounting pad, or printed circuit board (PCB), and have a second terminal wire bonded to the carrier substrate, electrical element, or PCB. Although certain embodiments shown in the figures may be appropriate for use with vertical LEDs, it is to be appreciated that the present disclosure is not so limited, such that any combination of one or more of the following LED configurations may be used in a single solid state light emitting device: horizontal LED chips, horizontal flip LED chips, vertical LED chips, vertical flip LED chips, and/or combinations thereof, with conventional or reverse polarity. Examples of vertical and horizontal LED chip structures are discussed by way of example in U.S. Publication No. 2008/0258130 to Bergmann et al. and in U.S. Pat. No. 7,791,061 to Edmond et al. which are hereby incorporated by reference herein.

Solid state light emitters may be used individually or in groups to emit one or more beams to stimulate emissions of one or more lumiphoric materials (e.g., phosphors, scintillators, lumiphoric inks, quantum dots, day glow tapes, etc.) to generate light at one or more peak wavelengths, or of at least one desired perceived color (including combinations of colors that may be perceived as white). Lumiphoric materials may be provided in the form of particles, films, or sheets.

Inclusion of lumiphoric (also called 'luminescent') materials in lighting devices as described herein may be accomplished by any suitable means, including: direct coating on solid state emitters, dispersal in encapsulant materials arranged to cover solid state emitters; coating on lumiphor support elements (e.g., by powder coating, inkjet printing, or the like); incorporation into diffusers or lenses; and the like. Examples of lumiphoric materials are disclosed, for example, in U.S. Pat. No. 6,600,175, U.S. Patent Application Publication No. 2009/0184616, and U.S. Patent Application Publication No. 2012/0306355, and methods for coating light emitting elements with phosphors are disclosed in U.S. Patent Application Publication No. 2008/0179611, with the foregoing publications being incorporated by reference. Other materials, such as light scattering elements (e.g., particles) and/or index matching materials, may be associated with a lumiphoric material-containing element or surface. One or more lumiphoric materials useable in devices as described herein may be down-converting or up-converting, or can include a combination of both types.

In certain embodiments, at least one lumiphoric material may be spatially segregated ("remote") from and arranged to receive emissions from at least one electrically activated solid state emitter, with such spatial separation reducing thermal coupling between a solid state emitter and lumiphoric material. In certain embodiments, a spatially segregated lumiphor may be arranged to fully cover one or more electrically activated emitters of a lighting device. In certain embodiments, a spatially segregated lumiphor may be arranged to cover only a portion or subset of one or more emitters electrically activated emitters.

In certain embodiments, at least one lumiphoric material may be arranged with a substantially constant thickness and/or concentration relative to different electrically activated emitters. In certain embodiments, one or more lumiphoric materials may be arranged with presence, thickness, and/or concentration that vary relative to different emitters. Multiple lumiphors (e.g., lumiphors of different compositions) may be applied with different concentrations or thicknesses relative to different electrically activated emitters. In one embodiment, lumiphor composition, thickness and/or concentration may vary relative to multiple electrically activated emitters, while scattering material thickness and/or concentration may differently vary relative to the same multiple electrically activated emitters. In one embodiment, at least one lumiphor material and/or scattering material may be applied to an associated support by patterning, such may be aided by one or more masks.

Various substrates may be used as mounting elements on which, in which, or over which multiple solid state light emitters (e.g., emitter chips) may be arranged or supported (e.g., mounted). Exemplary substrates include printed circuit boards (including but not limited to metal core printed circuit boards, flexible circuit boards, dielectric laminates, and the like) having electrical traces arranged on one or multiple surfaces thereof. A substrate, mounting plate, or other support element may include a printed circuit board (PCB), a metal core printed circuit board (MCPCB), a flexible printed circuit board, a dielectric laminate (e.g., FR-4 boards as known in the art) or any suitable substrate for mounting LED chips and/or LED packages. In certain embodiments, at least a portion of a substrate may include a dielectric material to provide desired electrical isolation between electrical traces or components of multiple LED sets. In certain embodiments, a substrate can comprise ceramic such as alumina, aluminum nitride, silicon carbide, or a polymeric material such as polyimide, polyester, etc. In certain embodiments, a substrate can comprise a flexible circuit board or a circuit board with plastically deformable portions to allow the substrate to take a non-planar (e.g., bent) or curved shape allowing for directional light emission with LED chips of one or more LED components also being arranged in a non-planar manner.

In certain embodiments, one or more LED components can include one or more "chip-on-board" (COB) LED chips and/or packaged LED chips that can be electrically coupled or connected in series or parallel with one another and mounted on a portion of a substrate. In certain embodiments, COB LED chips can be mounted directly on portions of substrate without the need for additional packaging.

Certain embodiments may involve use of solid state emitter packages. A solid state emitter package may include at least one solid state emitter chip (more preferably multiple solid state emitter chips) that is enclosed with packaging elements to provide environmental protection, mechanical protection, color selection, and/or light focusing utility, as well as electrical leads, contacts, and/or traces enabling electrical connection to an external circuit. One or more emitter chips may be arranged to stimulate one or more lumiphoric materials, which may be coated on, arranged over, or otherwise disposed in light receiving relationship to one or more solid state emitters. At least one lumiphoric material may be arranged to receive emissions of at least some emitters of a plurality of solid state light emitters and responsively emit lumiphor emissions. A lens and/or encapsulant material, optionally including lumiphoric material, may be disposed over solid state emitters, lumiphoric materials, and/or lumiphor-containing layers in a solid state emitter package.

In certain embodiments, a light emitting apparatus as disclosed herein (whether or not including one or more LED packages) may include at least one of the following items arranged to receive light from multiple LEDs: a single leadframe arranged to conduct electrical power to the plurality of electrically activated solid state light emitters; a single reflector arranged to reflect at least a portion of light emanating from the plurality of electrically activated solid state light emitters; a single submount or mounting element supporting the plurality of electrically activated solid state light emitters; a single lens arranged to transmit at least a portion of light emanating from the plurality of electrically activated solid state light emitters; and a single diffuser arranged to diffuse at least a portion of light emanating from the plurality of electrically activated solid state light emitters. In certain embodiments, a light emitting apparatus including multiple LEDs may include at least one of the following items arranged to receive light from multiple LEDs: multiple lenses; multiple optical elements; and multiple reflectors. Examples of optical elements include, but are not limited to elements arranged to affect light mixing, focusing, collimation, dispersion, and/or beam shaping.

Various devices disclosed herein may include multiple solid state emitters (e.g., LEDs) of the same or different dominant colors, or of the same or different peak wavelengths. In certain embodiments, a solid state light emitting and/or display device may include at least three colors such as red, green, and blue emitters, which may include solid state light emitters devoid of phosphors, or may include phosphors (e.g., in combination with UV and/or blue emitters) to generate one or more of the red, green, and blue colors. Other combinations of colors may be used. In certain embodiments, a solid state light emitting and/or display device may include at least two colors such as red and green, which may include solid state light emitters devoid of phosphors, or may include phosphors to generate one or more of the colors. Other combinations of output colors may be provided.

In certain embodiments, portions of solid state components or packages that are arranged around the periphery of reflector(s) and/or optical element(s), and that are subject to receiving ambient light, may be formed of (or coated with) dark colored light absorptive material in order to promote absorption (and reduce reflection) of ambient light. For example at least one reflector may be arranged to reflect at least a portion of emissions of the plurality of electrically activated solid state light emitter, and a light-absorbing material may be arranged around a periphery of the at least one reflector. An example of a light-absorbing material includes dark color polyphthalamide (PPA). Another example of a light-absorbing material includes black paint. Other light absorbing materials may be used. Desirable light absorbing materials may be substantially non-reflective, such as by preferably reflecting less than 10%, less than 8%, less than 6%, less than 5%, less than 4%, or less than 3% of incident light.

The term "notch filtering material" refers to a material that affects passage of light to cause light exiting the material to exhibit a spectral notch. A spectral notch is a portion of the color spectrum where the light is attenuated, thus forming a "notch" when light intensity is plotted against wavelength. Examples of notch filtering materials include rare earth and lanthanide materials, such as lanthanum, cerium, praseodymium, neodymium, promethium, samarium, europium, gadolinium, terbium, dysprosium, holmium, erbium, thulium, ytterbium, lutetium, scandium, and yttrium, as well as oxides thereof (e.g., neodymium oxide). Different rare earth compounds may exhibit notch filtering characteristics of different wavelength ranges. For example, neodymium (or oxide thereof) when used as a filtering material may produce a spectral notch in the yellow range, whereas erbium (or oxide thereof) when used as a filtering material may produce a spectral notch in the cyan range. Additional notch filtering materials include color pigments. As with the use of rare earth compounds, the use of color pigments can impart notch filtering properties in either transmissive or reflective applications. In many instances, color pigments may provide softer spectral notch (with more gradually sloping wavelength attenuation) characteristics relative to other notch filtering materials. One example of a color pigment includes an ultramarine pigment based on $CoAl_2O_4$, providing peak attenuation at a wavelength of about 580 nm. A cobalt blue pigment of similar composition could also be used. Other color pigments based on $CuSO_4$ or $NiCl_2$ can also be used. A variety of both natural and synthetic pigments are available and could be used as notch filtering materials according to embodiments of the present disclosure. Notch filters may also be fabricated by depositing one or more dielectric layers (e.g., to form dielectric stacks) on substrates.

Different notch filtering materials may exhibit spectral notches at different wavelength ranges and with different notch shapes (e.g., whether narrower or wider in notch shape). For example, optical notch filters are available from Thorlabs, Inc. (Newton, N.J., US) having the following center wavelengths (CWL) and full width at half maximum (FWHM) characteristics: CWL=488 nm, FWHM=15 nm; CWL=514 nm, FWHM=17 nm; CWL=533 nm, FWHM=17 nm; CWL=561 nm, FWHM=18 nm; CWL=594 nm, FWHM=23 nm; 633 nm, FWHM=25 nm; and CWL=658 nm, FWHM=26 nm, with the foregoing notch filters each including a dielectric stack on a polished glass substrate.

In certain embodiments, a spectral notch provided by at least one filtering material as disclosed herein may have a full width in a range of less than or equal to 40 nm, or less than or equal to 35 nm, or less than or equal to 30 nm, or less than or equal to 25 nm, or less than or equal to 20 nm, in each case corresponding to a half maximum relative reduction in light transmission.

In certain embodiments, notch filtering materials may be provided as microparticles or nanoparticles of any desired size, size distribution, and geometric shape. In certain embodiments, multiple notch filtering materials may be mixed and incorporated in a carrier or binder, or multiple notch filtering materials may otherwise be used in combination (e.g., in sequential layers, with or without a binding medium) to provide multiple spectral notches. In certain embodiments, notch filtering materials may be arranged in or on an at least partially light-transmissive optical element or enclosure, which may serve as a lens and/or diffuser. Examples of desirable materials for carriers, binding media, enclosures, and/or optical elements include (but are not limited to) silicone, resin, epoxy, thermoplastic polycondensate, polymeric materials, and glass. In certain embodiments, such materials may be molded and/or cured together with at least one notch filtering material.

In certain embodiments, one or more notch filtering materials may be mixed with one or more other functional materials (e.g., lumiphoric materials, scattering materials, and the like) and preferably incorporated into a binder or other carrier medium. In certain embodiments, at least one filtering material may be arranged in or on a carrier arranged on or over a plurality of solid state light emitters.

In certain embodiments, notch filtering materials may be arranged in or on a reflector, which may be either specularly reflective or diffusively reflective. Any suitable reflective material in the art may be used, including (but not limited to) MCPET (foamed white polyethylene terephthalate), and surfaces metalized with one or more metals such as (but not limited to) silver (e.g., a silvered surface). MCPET manufactured by Otsuka Chemical Co. Ltd. (Osaka, Japan) is a diffuse white reflector that has a total reflectivity of 99% or more, a diffuse reflectivity of 96% or more, and a shape holding temperature of at least about 160° C. A preferred light-reflective material would be at least about 90% reflective, more preferably at least about 95% reflective, and still more preferably at least about 98-99% reflective of light of a desired wavelength range, such as one or more of visible light, ultraviolet light, and/or infrared light, or subsets thereof. In certain embodiments, at least one notch filtering material may be deposited on a surface of a reflector by spray coating, sputtering, dipping, rolling, or other deposition methods. In certain embodiments, at least one notch filtering may be incorporated into a surface of a reflector via methods such as molding or sintering.

In certain embodiments, one or more notch filtering materials may be coated or otherwise arranged on, over, or against at least one surface of one or more one solid state emitter chips. In certain embodiments, one or more notch filtering materials may be coated or otherwise arranged on, over, or against at least one surface of at least one lumiphoric material, wherein the at least one lumiphoric material may be arranged in direct contact with at least one surface of a solid state emitter chip, or may be arranged remotely from (i.e., spatially segregated from) at least one surface of a solid state emitter chip. In certain embodiments, one or more notch filtering materials may be conformally coated on the surface of at least one solid state emitter chip and/or lumiphoric material, wherein conformal coating in this regard refers to a coating that follows the shape and contour of at least one surface (or preferably multiple surfaces) of a chip with a substantially uniform thickness.

As will be recognized by one skilled in the art, parameters such as the type or composition of carrier or binding medium; the thickness, concentration, particle size, and particle size distribution of notch filtering material(s); and the presence, amount, and type of other trace substances accompanying one or notch filtering elements, may be adjusted to provide one or more spectral notches of desired width and/or depth.

In certain embodiments, notch filtering materials may be selected to provide neutral color reflectance of ambient light, which may be desirable in certain contexts. In other embodiments, notch filtering materials may be selected to reflect ambient light and provide a tint of any desired color. For example, notch filtering materials may be selected to reflect ambient light and provide a blue tint, which may tend to attenuate yellow light more than cyan light.

In certain embodiments, a notch filtering material may be arranged to cover only reflector and emitter portions of one or more solid state light emitting devices, without covering peripheral material (preferably light absorbing in character) arranged to peripherally bound reflector portions. In other embodiments, a notch filtering material may be arranged to cover reflector portions, emitter portions, and peripheral material portions. In certain embodiments, one or more notch filtering materials may be integrated with or arranged in contact with one or more portions of a solid state emitter package. In other embodiments, one or more notch filtering materials may be spatially segregated (i.e., positioned remotely) from emitter packages in a display device.

In certain embodiments, at least one filtering material may be provided in a light path between at least some solid state light emitters and at least one light output surface of a light emitting or display device, and arranged to filter ambient light so that reflected ambient light exhibits at least one spectral notch, wherein the at least one spectral notch is non-overlapping with a majority or an entirety of spectral output of each solid state light emitter. In certain embodiments, the wavelength spectrum corresponding to full width at half maximum (FWHM) attenuation of the at least one spectral notch is non-overlapping with spectra corresponding to one-half, or more preferably one-fourth, maximum output of first and second (or of first, second, and third) solid state light emitters (which may embody LEDs or LEDs in combination with lumiphoric materials) having different dominant wavelengths. In certain embodiments, the wavelength spectrum corresponding to full width at half maximum (FWHM) attenuation of the at least one spectral notch is non-overlapping with the entire spectral ranges of first and second (or of first, second, and third) solid state light emitters having different dominant wavelengths.

In certain embodiments, a light emitting device or display device as disclosed herein may include one or more of a high pass filter and a low pass filter (or preferably both a high pass filter and a low pass filter) to provide extra contrast for wavelengths beyond the spectra of solid state emitters associated with the lighting or display device. In certain embodiments, a high pass optical filter may be arranged to transmit at least some visible light having wavelengths of 420 nm or greater (e.g., above violet). In certain embodiments, a low pass optical filter arranged to transmit at least some visible light having wavelengths of 700 nm or smaller (e.g., below near-infrared). One or both of a high pass filter and/or a low pass filter may be arranged in a light path at least some solid state light emitters and at least one light output surface of the solid state lighting or display device.

In certain embodiments, a display device as disclosed herein may be adapted to display at least one of test and visual images. Such a display device may embody a multi-color sequentially illuminated LED display device, such as a two-color (e.g., RG) or three-color (e.g., RGB) display. In certain embodiments, a display device as disclosed herein may include signal processing and emitter drive circuitry electrically connected to a plurality of electrically activated solid state light emitters to selectively energize emitters of the plurality of electrically activated solid state light emitters to produce text and/or visual images on the display device. In certain embodiments, an electrically activated solid state light emitter may include an array of electrically activated solid state light emitters (e.g., an array of light emitting diodes) arranged in multiple vertical columns and multiple horizontal rows.

In certain embodiments, at least one filtering material may be arranged in a light path between (i) at least some solid state light emitters of the display device and (ii) at least one light output surface of the display. In certain embodiments, at least one filtering material may be arranged to receive ambient light incident on the display device such that at least a portion of reflected ambient light exhibits at least one spectral notch.

In certain embodiments directed to a two-color display device or a component (e.g., LED package) thereof, solid state emitters including first and second dominant wavelengths may be provided, and at least one filtering material may be arranged to receive ambient light incident on the display device such that at least a portion of reflected ambient light exiting the display device exhibits a first spectral notch, wherein the first spectral notch comprises a wavelength of greatest attenuation in a spectrum between the first dominant wavelength and the second dominant wavelength.

In certain embodiments, a plurality of electrically activated solid state light emitters may be arranged in a plurality of clusters, and each cluster may include at least one emitter of a first group of solid state light emitters and at least one emitter of a second group of solid state light emitters, wherein emitters of the first group have a first dominant wavelength and emitters of the second group have a second dominant wavelength In certain embodiments, the first wavelength and the second wavelength differ by at least 50 nm. In certain embodiments, a display device may include a plurality of electrically activated solid state emitters arranged in a plurality of solid state light emitter packages, and each solid state light emitter package of the plurality of solid state light emitter packages may include at least one emitter of the first group and the second group of solid state light emitters. In certain embodiments, at least one emitter of any of the first group and the second group comprises a lumiphoric material.

In certain embodiments directed to a three-color display device or a component (e.g., solid state emitter package) thereof, solid state emitters including first, second, and third dominant wavelengths may be provided, and first and second filtering materials may be arranged to receive ambient light incident on the display device such that at least a portion of reflected ambient light exiting the display device exhibits a first spectral notch and a second spectral, wherein the first spectral notch comprises a first wavelength of greatest attenuation in a spectrum between the first dominant wavelength and the second dominant wavelength, and the second spectral notch comprises a second wavelength of greatest attenuation in a spectrum between the second dominant wavelength and the third dominant wavelength.

In certain embodiments, a plurality of electrically activated solid state light emitters may be arranged in a plurality of clusters, and each cluster may include at least one emitter of a first group, a second group, and a third group of solid state light emitters, wherein emitters of the first group have a first dominant wavelength, emitters of the second group have a second dominant wavelength, and emitters of the third group have a third dominant wavelength. In certain embodiments, the second dominant wavelength exceeds the first dominant wavelength by at least 40 nm, and the third dominant wavelength exceeds the second dominant wavelength by at least 50 nm. In certain embodiments, the third dominant wavelength differs from the first dominant wavelength by at least 100 nm and differs from the second dominant wavelength by at least 50 nm. In certain embodiments, a display device may include a plurality of electrically activated solid state emitters arranged in a plurality of solid state light emitter packages, and each solid state light emitter package of the plurality of solid state light emitter packages may include at least one emitter of each of the first group, the second group, and the third group of solid state light emitters. In certain embodiments, at least one emitter of any of the first group, the second group, and the third group comprises a lumiphoric material. In certain embodiments, the first dominant wavelength is in a range of from 441 nm to 495 nm, the second dominant wavelength is in a range of from 496 nm to 570 nm, and the third dominant wavelength is in a range of from 591 nm to 750 nm.

In certain embodiments, a display device adapted to display at least one of text and visual images (or a component of a display, such as a solid state emitter package) may include a plurality of electrically activated solid state light emitters (e.g., an array of LEDs) and at least one filtering material. The plurality of solid state light emitters may include a first group of solid state emitters arranged to generate emissions having a first dominant wavelength and a second group of solid state emitters arranged to generate emissions having a second dominant wavelength that differs from the first dominant wavelength by at least 50 nm. The at least one filtering material may be arranged in a light path between (i) at least some solid state light emitters of the plurality of electrically activated solid state light emitters and (ii) at least one light output surface of the display device, wherein the at least one filtering material is arranged to receive ambient light incident on the display device such that at least a portion of reflected ambient light exiting the display device exhibits a first spectral notch, wherein the first spectral notch comprises a wavelength of greatest attenuation in a spectrum between the first dominant wavelength and the second dominant wavelength. In certain embodiments, wavelength spectrum corresponding to full width at half maximum (FWHM) attenuation of the first spectral notch may be non-overlapping with respect to a majority of spectral output (according to thresholds disclosed herein) or an entirety of spectral output of each of the first group and the second group of solid state light emitters. In certain embodiments, a wavelength spectrum corresponding to full width at half maximum (FWHM) attenuation of the first spectral notch is non-overlapping with each of the following spectra: spectrum corresponding to one-half (or corresponding to one fourth) maximum output of the first group of solid state light emitters; and spectrum corresponding to one-half (or corresponding to one fourth) maximum output of the second group of solid state light emitters. In certain embodiments, a wavelength spectrum corresponding to full width at half maximum (FWHM) attenuation of the first spectral notch is non-overlapping with each of spectrum of the first group of solid state emitters and spectrum of the second group of solid state emitters. In certain embodiments, the display device may include signal processing and emitter drive circuitry electrically connected to the plurality of electrically activated solid state light emitters to selectively energize emitters of the plurality of electrically activated solid state light emitters to produce at least one of text and visual images on the display device. In certain embodiments, the first dominant wavelength may be in a range of from 496 nm to 570 nm, and the second dominant wavelength may be in a range of from 591 nm to 750 nm. In certain embodiments, a light absorbing material may be arranged between at least some solid state light emitters of the plurality of emitters, and/or around a periphery of the at least one reflector. In certain embodiments, the plurality of solid state emitters may be arranged in a plurality of solid state emitter packages with each package including at least one emitter of the first group and of the second group, and at least one emitter of any of the first group and the second group of electrically activated solid state light emitters may comprise a lumiphoric material. In certain embodiments, the first spectral notch may include a full width of less than 40 nm corresponding to a half maximum relative reduction in light transmission. In certain embodiments, the at least one filtering material may serve to attenuate intensity of emissions output by the display device by less than 10%. In certain embodiments, the plurality of electrically activated solid state light emitters may further include a third group of solid state emitters arranged to generate emissions having a third dominant wavelength that differs from of the first dominant wavelength by at least 100 nm and differs from the second dominant wavelength by at least 50 nm, and at least one filtering material includes at least one other notch filtering material arranged to receive ambient light incident on the display device such that at least a portion of reflected ambient light exiting the display device exhibits a second spectral notch, wherein the second spectral notch comprises a wavelength of greatest attenuation between the second dominant wavelength and the third dominant wavelength. In certain embodiments, wavelength spectrum corresponding to full width at half maximum (FWHM) attenuation of the second spectral notch may be non-overlapping with respect to a majority of spectral output (according to thresholds disclosed herein, such as spectra corresponding to less than one-half or less than one-fourth maximum output of each solid state emitter) or an entirety of spectral output of each of the second group and the third group of solid state light emitters.

In certain embodiments, a display device adapted to display at least one of text and visual images (or a component of a display, such as a solid state emitter package) may include a plurality of electrically activated solid state light emitters and at least two filtering materials. A plurality of electrically activated solid state light emitters (e.g., which may include an array of LEDs) may include at least one first solid state light emitter comprising a first dominant wavelength in a range of from 441 nm to 495 nm, at least one second solid state light emitter comprising a second dominant wavelength in a range of from 496 nm to 570 nm, and at least one third solid state light emitter comprising a third dominant wavelength in a range of from 591 nm to 750 nm. A first filtering material may be arranged in a light path between at least some solid state light emitters of the plurality of electrically activated solid state light emitters and at least one light output surface of the display device. The first filtering material may be arranged to receive ambient light incident on the display device such that at least a portion of reflected ambient light exhibits a first spectral notch, wherein the first spectral notch comprises a first wavelength of greatest attenuation in a spectrum between the first dominant wavelength and the second dominant wavelength. A second filtering material may be arranged in a light path between at least some solid state light emitters of the plurality of electrically activated solid state light emitters and at least one light output surface of the display device. The second filtering material may be arranged to receive ambient light incident on the display device such that at least a portion of reflected ambient light exhibits a second spectral notch, wherein the second spectral notch comprises a second wavelength of greatest attenuation in a spectrum between the second dominant wavelength and the third dominant wavelength. In certain embodiments, the wavelength spectrum corresponding to full width at half maximum (FWHM) attenuation of the first spectral notch may be non-overlapping with respect to a majority of spectral output (according to thresholds disclosed herein) or an entirety of spectral output of the first and the second solid state light emitters, and wavelength spectrum corresponding to full width at half maximum (FWHM) attenuation of the second spectral notch may be non-overlapping with respect to a majority of spectral output (according to thresholds disclosed herein, such as spectra corresponding to less than one-half or less than one-fourth maximum output of each solid state emitter) or an entirety of spectral output of the second and the third solid state light emitters. In certain embodiments, the display device may comprise signal processing and emitter drive circuitry electrically connected to the plurality of electrically activated solid state light emitters to selectively energize emitters of the plurality of electrically activated solid state light emitters to produce at least one of text and visual images on the display device. In certain embodiments, the first filtering material may comprise erbium, and the second filtering material may comprise neodymium. In certain embodiments, a light absorbing material arranged between at least some emitters of the plurality of emitters. In certain embodiments, the at least one first solid state light emitter may comprise a plurality of first solid state light emitters, the at least one second solid state light emitter may comprise a plurality of second solid state light emitters, and the at least one third solid state light emitter may comprise a plurality of third solid state light emitters. In certain embodiments, the plurality of electrically activated solid state emitters may be arranged in a plurality of clusters, wherein each cluster of the plurality of clusters includes at least one emitter of the plurality of first solid state light emitters, at least one emitter of the plurality of second solid state light emitters, and at least one emitter of the plurality of third solid state light emitters. In certain embodiments, the plurality of electrically activated solid state emitters are arranged in a plurality of solid state emitter packages, wherein each package includes at least one emitter of the plurality of first, the plurality of second, and the plurality of third solid state emitters. In certain embodiments, in each solid state light emitter package, at least one emitter of any of the first group, the second group, and the third group comprises a lumiphoric material. In certain embodiments, the emitters may be arranged in an array of multiple vertical columns and multiple horizontal rows. In certain embodiments, the first and second filtering materials may be conformally coated on the solid state light emitters. In certain embodiments, the first and second filtering materials may be arranged in a carrier arranged on or over the solid state emitters.

In certain embodiments, a solid state light emitting device (e.g., a solid state emitter package) may include a plurality of electrically activated solid state light emitters including at least one first solid state light emitter arranged to generate emissions comprising a first dominant wavelength, and at least one second solid state light emitter arranged to generate emissions comprising a second dominant wavelength. At least one filtering material may be arranged in a light path between at least some solid state light emitters of the plurality of electrically activated solid state light emitters and at least one light output surface of the solid state lighting device, wherein the least one filtering material is arranged to receive ambient light incident on the solid state lighting device such that at least a portion of reflected ambient light exhibits a first spectral notch, wherein the first spectral notch comprises a wavelength of greatest attenuation in a spectrum between the first dominant wavelength and the second dominant wavelength.

In certain embodiments, a solid state light emitting device (e.g., a solid state light emitter package) includes a plurality of electrically activated solid state light emitters that includes at least one first solid state light emitter arranged to generate emissions comprising a first dominant wavelength, at least one second solid state light emitter arranged to generate emissions comprising a second dominant wavelength, and at least one third solid state light emitter arranged to generate emissions comprising a third dominant wavelength. A first filtering material may be arranged in a light path between at least some solid state light emitters of the plurality of electrically activated solid state light emitters and at least one light output surface of the solid state lighting device, wherein the first filtering material is arranged to receive ambient light incident on the solid state lighting device such that at least a portion of reflected ambient light exhibits a first spectral notch, wherein the first spectral notch comprises a first wavelength of greatest attenuation in a spectrum between the first dominant wavelength and the second dominant wavelength. A second filtering material may be arranged in a light path between at least some solid state light emitters of the plurality of electrically activated solid state light emitters and at least one light output surface of the solid state lighting device, wherein the second filtering material is arranged to receive ambient light incident on the solid state lighting device such that at least a portion of reflected ambient light exhibits a second spectral notch, wherein the first spectral notch comprises a second wavelength of greatest attenuation in a spectrum between the second dominant wavelength and the third dominant wavelength.

Further illustrative embodiments and features are shown and described in connection with the drawings.

Figure 3A:
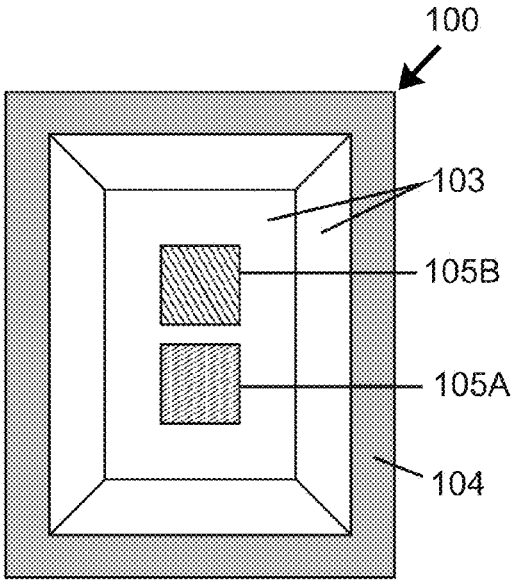
FIG. 3A is a top plan schematic view of at least a portion of a solid state light emitting device including two solid state emitter chips arranged in a reflector cavity according to one embodiment.
Figure 3D:
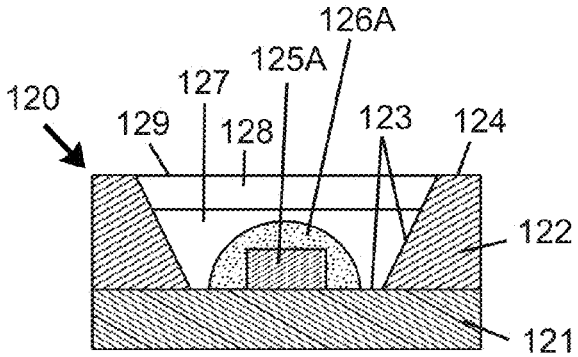
FIG. 3D is a side cross-sectional schematic view of at least a portion of a solid state light emitting device similar to FIG. 3A, with addition of a wavelength conversion material covering at least one emitter chip, an encapsulant material covering the wavelength conversion material within the reflector cavity, and least one filtering material arranged over the wavelength conversion material and at least partially contained within the reflector cavity.
Figure 3B:
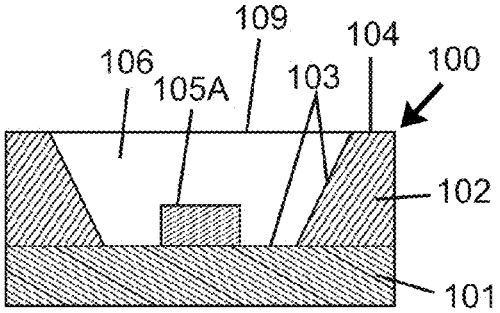
FIG. 3B is a side cross-sectional schematic view of the at least a portion of a solid state light emitting device according to FIG. 3A.

FIGS. 3A-3B schematically illustrate at least a portion of a solid state light emitting device 100 including two solid state emitter chips 105A, 105B arranged over a submount or substrate 101 and within a cavity bounded laterally by walls 102. The walls 102 and portion of the substrate 101 may be coated, impregnated, or otherwise fabricated with a reflective material to form a reflector 103 arranged to reflect at least a portion of emissions of the emitter chips 105A, 105B toward a light output surface 109 of the device 100. An encapsulant material 106 is provided over the emitter chips 105A, 105B and substantially fills the cavity bounded by the walls 102 and the substrate 101. The emitter chips 105A, 105B may optionally include one or more lumiphoric materials. Although not shown in FIGS. 3A-3B, a lens of any desirable shape may be arranged over the encapsulant 106. A peripheral region 104 of the light emitting device 100, embodying a top surface of the walls 102 that are peripherally arranged around the reflector 103, may be fabricated of a light absorbing (e.g., dark) material in order to reduce reflection of ambient light impinging on the device 100. The light emitting device 100 may include at least one filtering material mixed with the encapsulant 106, preferably arranged to receive ambient light incident on the light emitting device 100 such that at least a portion of reflected ambient light exhibits a spectral notch, wherein the spectral notch comprises a wavelength of greatest attenuation in a spectrum between a first dominant wavelength of the first emitter chip 105A and a second dominant wavelength of the second emitter chip 105B. Preferably the first and second dominant wavelengths differ by at least 40 nm, at least 50 nm, or another desired threshold value.

Figure 3E:
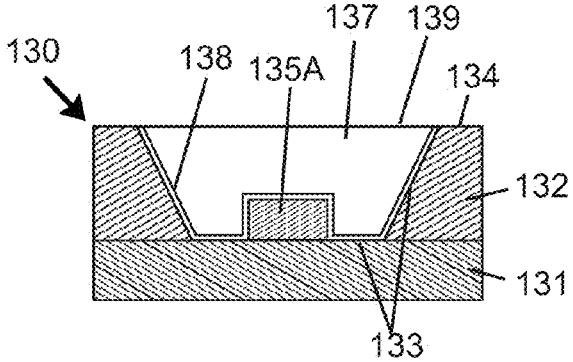
FIG. 3E is a side cross-sectional schematic view of at least a portion of a solid state light emitting device similar to FIG. 3A, with addition of at least one filtering material covering at least one emitter chip and reflective surfaces of the reflector cavity.
Figure 3C:
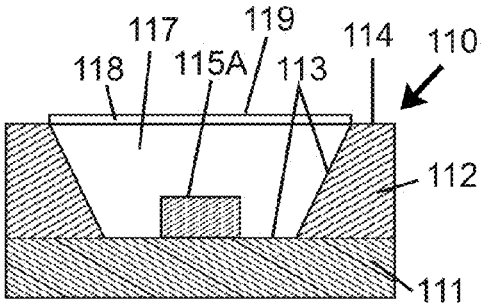
FIG. 3C is a side cross-sectional schematic view of at least a portion of a solid state light emitting device similar to FIG. 3A with addition of at least one filtering material arranged over an encapsulant contained within the reflector cavity and covering the emitter chips.

FIG. 3C schematically illustrates at least a portion of another solid state light emitting device 110 including multiple emitter chips (e.g., including chip 115A as illustrated) similar to the device 100 of FIGS. 3A-3B, but with addition of at least one filtering material layer 118 arranged over an encapsulant or lens material 117 covering the emitter chips 115A and reflector 113, which is bounded by the substrate or submount 111 and side walls 112. The filtering material layer 118 may embody a light output surface 119 of the device 110. A peripheral region 114 embodying a top surface of the walls 112 that is peripherally arranged around the reflector 113 may be fabricated of a light absorbing material. The at least one filtering material layer 118 is arranged to receive ambient light incident on the light emitting device 110 such that at least a portion of reflected ambient light exhibits a spectral notch, wherein the spectral notch comprises a wavelength of greatest attenuation in a spectrum between a first dominant wavelength of the first emitter chip 115A and a second dominant wavelength of a second emitter chip (not shown in FIG. 3C, but corresponding to chip 105B in FIG. 3A).

FIG. 3D schematically illustrates at least a portion of another solid state light emitting device 120 including multiple emitter chips (e.g., including chip 125A as illustrated) similar to the device 100 of FIGS. 3A-3B, but with addition of a wavelength conversion material 126A covering at least one emitter chip 125A, an encapsulant material 127 covering the wavelength conversion material 126A within a cavity bounded by the reflector 123, and least one filtering material 128 arranged over the wavelength conversion material 126A and at least partially contained within the reflector cavity. The reflector 123 is bounded by the substrate or submount 121 and side walls 122. A top surface of the filtering material layer 128 may embody a light output surface 129 of the device 120. A peripheral region 124 embodying a top surface of the walls 122 that is peripherally arranged around the reflector 123 may be fabricated of a light absorbing material. The at least one filtering material 128 is arranged to receive ambient light incident on the light emitting device 120 such that at least a portion of reflected ambient light exhibits a spectral notch, wherein the spectral notch comprises a wavelength of greatest attenuation in a spectrum between a first dominant wavelength of the first emitter chip 125A and a second dominant wavelength of a second emitter chip (not shown in FIG. 3D, but corresponding to chip 105B in FIG. 3A).

FIG. 3E schematically illustrates at least a portion of another solid state light emitting device 130 including multiple emitter chips (e.g., including chip 135A as illustrated) similar to the device 100 of FIGS. 3A-3B, but with addition of at least one filtering material layer 138 covering at least one emitter chip 135A and covering reflective surfaces of the reflector cavity (forming a reflector 133). The reflector 133 is bounded by the substrate or submount 131 and side walls 132. Encapsulant and/or lens material 137 may be arranged in the cavity to cover the at least one filtering material layer 138. A top surface of the encapsulant and/or lens material 137 may embody a light output surface 139 of the device 130. A peripheral region 134 embodying a top surface of the walls 132 that is peripherally arranged around the reflector 133 may be fabricated of a light absorbing material. When ambient light is incident on the light emitting device 130 and is transmitted through the encapsulant or lens material 137, the at least one filtering material layer 138 is arranged over the reflector 133 such that at least a portion of reflected ambient light exhibits a spectral notch, wherein the spectral notch comprises a wavelength of greatest attenuation in a spectrum between a first dominant wavelength of the first emitter chip 135A and a second dominant wavelength of a second emitter chip (not shown in FIG. 3E, but corresponding to chip 105B in FIG. 3A).

Figure 3F:
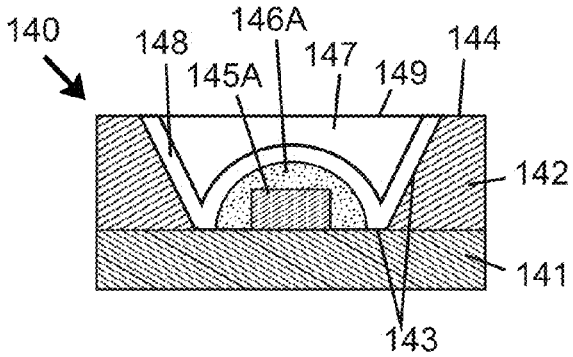
FIG. 3F is a side cross-sectional schematic view of at least a portion of a solid state light emitting device similar to FIG. 3A, with addition of a wavelength conversion material covering at least one emitter chip, and a filtering material covering the wavelength conversion material and reflective surfaces of the reflector cavity.

FIG. 3F schematically illustrates at least a portion of another solid state light emitting device 140 including multiple emitter chips (e.g., including chip 145A as illustrated) similar to the device 100 of FIGS. 3A-3B, but with addition of a wavelength conversion material 146A covering at least one emitter chip 145A, and a filtering material 148 covering the wavelength conversion material 146A and reflective surfaces of the reflector 143. The reflector 143 is bounded by the substrate or submount 141 and side walls 142. Encapsulant and/or lens material 147 may be arranged in the cavity to cover the at least one filtering material layer 148. A top surface of the encapsulant and/or lens material 147 may embody a light output surface 149 of the device 140. A peripheral region 144 embodying a top surface of the walls 142 that is peripherally arranged around the reflector 143 may be fabricated of a light absorbing material. When ambient light is incident on the light emitting device 140 and is transmitted through the encapsulant or lens material 147, the at least one filtering material layer 148 is arranged over the reflector 143 such that at least a portion of reflected ambient light exhibits a spectral notch, wherein the spectral notch comprises a wavelength of greatest attenuation in a spectrum between a first dominant wavelength of the first emitter chip 145A and a second dominant wavelength of a second emitter chip (not shown in FIG. 3C, but corresponding to chip 105B in FIG. 3A).

Multiple lighting emitting 100, 110, 120, 130, 140 may be combined in an array and operated to form a two-color display device.

Figure 4A:
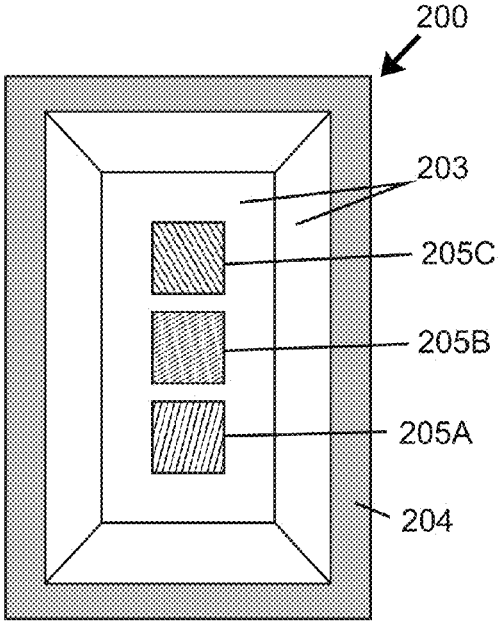
FIG. 4A is a top plan schematic view of at least a portion of a solid state light emitting device including three solid state emitter chips arranged in a reflector cavity according to one embodiment.
Figure 4D:
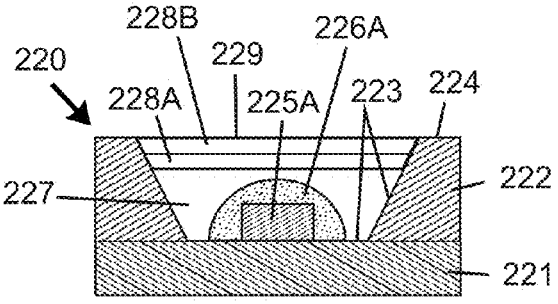
FIG. 4D is a side cross-sectional schematic view of at least a portion of a solid state light emitting device similar to FIG. 4A, with addition of a wavelength conversion material covering at least one emitter chip, an encapsulant material covering the wavelength conversion material within the reflector cavity, and multiple filtering materials arranged over the reflector cavity and at least partially contained within the reflector cavity.
Figure 4B:
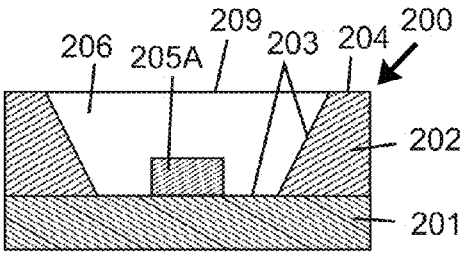
FIG. 4B is a side cross-sectional schematic view of the at least a portion of a solid state light emitting device according to FIG. 4A.

FIGS. 4A-4B schematically illustrate at least a portion of a solid state light emitting device 200 including three solid state emitter chips 205A-205C arranged over a submount or substrate 201 and within a cavity bounded laterally by walls 202. The walls 202 and portion of the substrate 201 may be coated, impregnated, or otherwise fabricated with a reflective material to form a reflector 203 arranged to reflect at least a portion of emissions of the emitter chips 205A-205C toward a light output surface 209 of the device 200. An encapsulant material 206 is provided over the emitter chips 205A-205C and substantially fills the cavity bounded by the walls 202 and the substrate 201. The emitter chips 205A-205C may optionally include one or more lumiphoric materials. Although not shown in FIGS. 4A-4B, a lens of any desirable shape may be arranged over the encapsulant 206. A peripheral region 204 of the light emitting device 200, embodying a top surface of the walls 202 that are peripherally arranged around the reflector 203, may be fabricated of a light absorbing (e.g., dark) material in order to reduce reflection of ambient light impinging on the device 200. The light emitting device 200 may include first and second filtering materials mixed with the encapsulant 206, preferably arranged to receive ambient light incident on the light emitting device 200 such that at least a portion of reflected ambient light exhibits a first and a second spectral notch, wherein the first spectral notch comprises a first wavelength of greatest attenuation in a spectrum between a first dominant wavelength of the first emitter chip 205A and a second dominant wavelength of the second emitter chip 205B, and the second spectral notch comprises a second wavelength of greatest attenuation in a spectrum between the second dominant wavelength of the second emitter chip 205B and a third dominant wavelength of the third emitter chip 205C. Preferably the second dominant wavelength may exceed the first dominant wavelength by at least 40 nm, and the third dominant wavelength may exceed the second dominant wavelength by at least 50 nm. Alternatively, the third dominant wavelength may differ from the first dominant wavelength by at least 100 nm and differ from the second dominant wavelength by at least 50 nm.

Figure 4E:
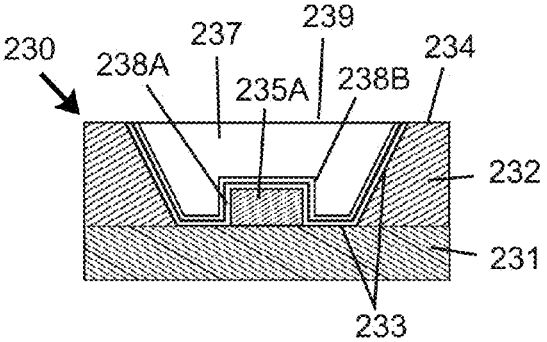
FIG. 4E is a side cross-sectional schematic view of at least a portion of a solid state light emitting device similar to FIG. 4A, with addition of multiple wavelength conversion materials covering at least one emitter chip and reflective surfaces of the reflector cavity.
Figure 4C:
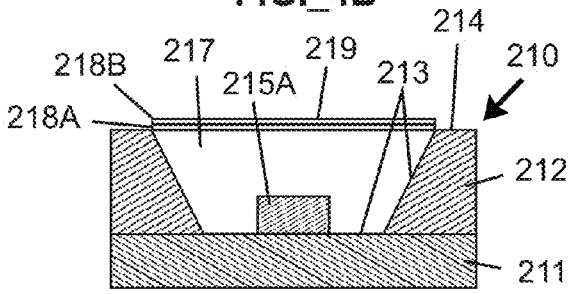
FIG. 4C is a side cross-sectional schematic view of at least a portion of a solid state light emitting device similar to FIG. 4A with addition of multiple filtering materials arranged over an encapsulant contained within the reflector cavity and covering the emitter chips.

FIG. 4C schematically illustrates at least a portion of another solid state light emitting device 210 including three emitter chips (e.g., including chip 215A as illustrated) similar to the device 200 of FIGS. 4A-4B, but with addition of multiple filtering material layers 218A, 218B arranged over an encapsulant or lens material 217 covering the emitter chips 215A and reflector 213, which is bounded by the substrate or submount 211 and side walls 212. The uppermost filtering material layer 218B may embody a light output surface 219 of the device 210. A peripheral region 214 embodying a top surface of the walls 212 that is peripherally arranged around the reflector 213 may be fabricated of a light absorbing material. The filtering material layers 218A, 218B are arranged to receive ambient light incident on the light emitting device 210 such that at least a portion of reflected ambient light exhibits a first and a second spectral notch, wherein the first spectral notch comprises a first wavelength of greatest attenuation in a spectrum between a first dominant wavelength of the first emitter chip 205A and a second dominant wavelength of a second emitter chip, and the second spectral notch comprises a second wavelength of greatest attenuation in a spectrum between the second dominant wavelength of the second emitter chip and a third dominant wavelength of the third emitter chip (wherein the second and third emitter chips are not shown in FIG. 4C, but correspond to chips 205B, 205C in FIG. 4A).

FIG. 4D schematically illustrates at least a portion of another solid state light emitting device 220 including three emitter chips (e.g., including chip 225A as illustrated) similar to the device 200 of FIGS. 4A-4B, but with addition of a wavelength conversion material 226A covering at least one emitter chip 225A, an encapsulant material 227 covering the wavelength conversion material 226A within a cavity bounded by the reflector 223, and multiple filtering material layers 228A, 228B arranged over the wavelength conversion material 226A and at least partially contained within the reflector cavity. The reflector 223 is bounded by the substrate or submount 221 and side walls 222. A top surface of an uppermost filtering material layer 228B may embody a light output surface 229 of the device 220. A peripheral region 224 embodying a top surface of the walls 222 that is peripherally arranged around the reflector 223 may be fabricated of a light absorbing material. The filtering materials of layers 228A, 228B are arranged to receive ambient light incident on the light emitting device 220 such that at least a portion of reflected ambient light exhibits first and second spectral notches, wherein the first spectral notch comprises a first wavelength of greatest attenuation in a spectrum between a first dominant wavelength of the first emitter chip 205A and a second dominant wavelength of a second emitter chip, and the second spectral notch comprises a second wavelength of greatest attenuation in a spectrum between the second dominant wavelength of the second emitter chip and a third dominant wavelength of the third emitter chip (wherein the second and third emitter chips are not shown in FIG. 4D, but correspond to chips 205B, 205C in FIG. 4A).

FIG. 4E schematically illustrates at least a portion of another solid state light emitting device 230 including multiple emitter chips (e.g., including chip 235A as illustrated) similar to the device 200 of FIGS. 4A-4B, but with addition of multiple filtering material layers 238A, 238B covering at least one emitter chip 235A and covering reflective surfaces of the reflector cavity (forming a reflector 233). The reflector 233 is bounded by the substrate or submount 231 and side walls 232. Encapsulant and/or lens material 237 may be arranged in the cavity to cover the filtering material layers 238A, 238B. A top surface of the encapsulant and/or lens material 237 may embody a light output surface 239 of the device 230. A peripheral region 234 embodying a top surface of the walls 232 that is peripherally arranged around the reflector 233 may be fabricated of a light absorbing material. When ambient light is incident on the light emitting device 230 and is transmitted through the encapsulant or lens material 237, the filtering material layers 238A, 238B are arranged over the reflector 233 such that at least a portion of reflected ambient light exhibits first and second spectral notches, wherein the first spectral notch comprises a first wavelength of greatest attenuation in a spectrum between a first dominant wavelength of the first emitter chip 205A and a second dominant wavelength of a second emitter chip, and the second spectral notch comprises a second wavelength of greatest attenuation in a spectrum between the second dominant wavelength of the second emitter chip and a third dominant wavelength of the third emitter chip (wherein the second and third emitter chips are not shown in FIG. 4E, but correspond to chips 205B, 205C in FIG. 4A).

Figure 4F:
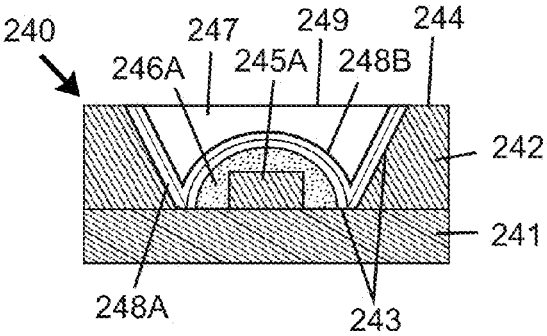
FIG. 4F is a side cross-sectional schematic view of at least a portion of a solid state light emitting device similar to FIG. 4A, with addition of a wavelength conversion material covering at least one emitter chip, and multiple filtering materials covering the wavelength conversion material and reflective surfaces of the reflector cavity.

FIG. 4F schematically illustrates at least a portion of another solid state light emitting device 240 including multiple emitter chips (e.g., including chip 245A as illustrated) similar to the device 200 of FIGS. 4A-4B, but with addition of a wavelength conversion material 246A covering at least one emitter chip 245A, and a filtering materials 248A, 248B covering the wavelength conversion material 246A and reflective surfaces of the reflector 243. The reflector 243 is bounded by the substrate or submount 241 and side walls 242. Encapsulant and/or lens material 247 may be arranged in the cavity to cover the filtering material layers 248A, 248B. A top surface of the encapsulant and/or lens material 247 may embody a light output surface 249 of the device 240. A peripheral region 244 embodying a top surface of the walls 242 that is peripherally arranged around the reflector 243 may be fabricated of a light absorbing material. When ambient light is incident on the light emitting device 240 and is transmitted through the encapsulant or lens material 247, the filtering material layers 248A, 248B are arranged over the reflector 243 such that at least a portion of reflected ambient light exhibits first and second spectral notches, wherein the first spectral notch comprises a first wavelength of greatest attenuation in a spectrum between a first dominant wavelength of the first emitter chip 205A and a second dominant wavelength of a second emitter chip, and the second spectral notch comprises a second wavelength of greatest attenuation in a spectrum between the second dominant wavelength of the second emitter chip and a third dominant wavelength of the third emitter chip (wherein the second and third emitter chips are not shown in FIG. 4F, but correspond to chips 205B, 205C in FIG. 4A).

Although FIGS. 4C-4F illustrate first and second notch filtering materials in distinct layers or regions, it is to be appreciated that in alternative embodiments multiple notch filtering materials may be mixed with one another and incorporated into a single (e.g., substantially uniform) layer or region.

Figure 5:
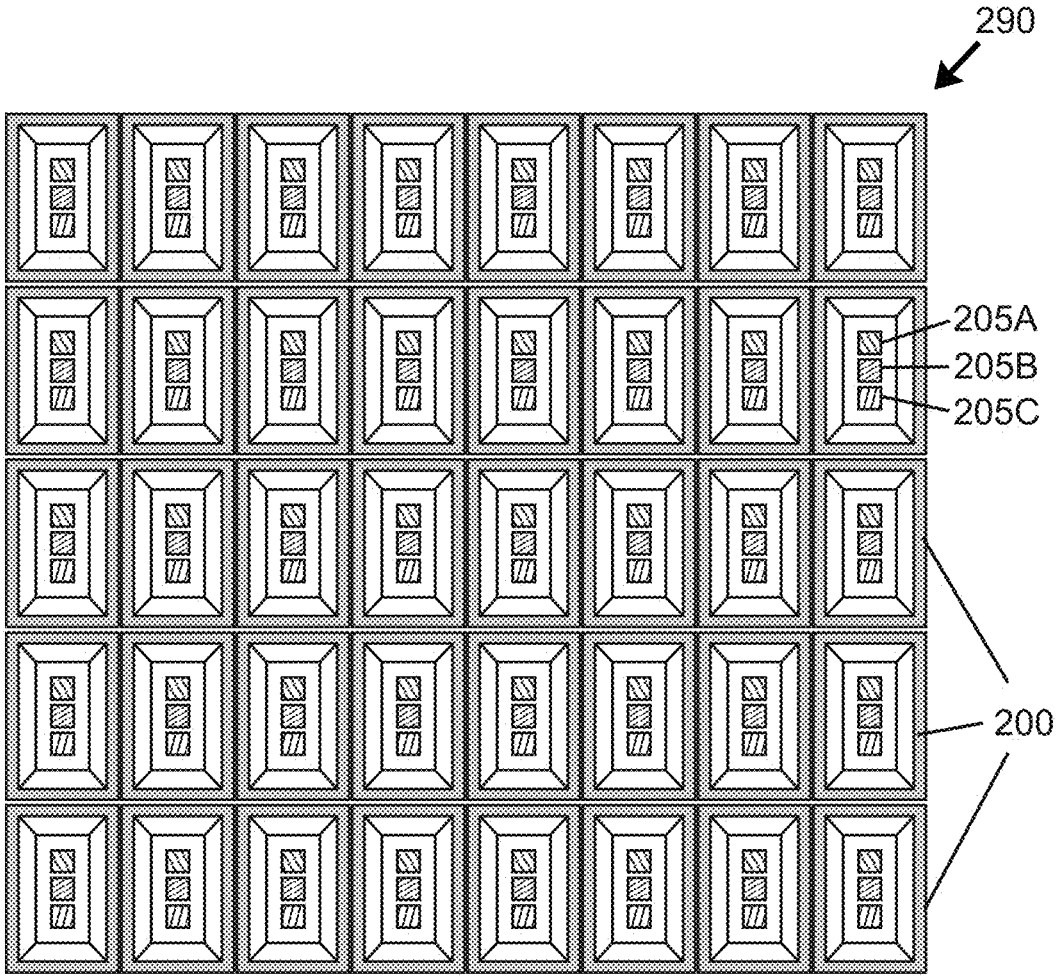
FIG. 5 is a top plan view of an array of multiple solid state light emitting devices according to at least one of FIGS. 4A-4F, useable as or within a LED display device.

Multiple lighting emitting devices 200, 210, 220, 230, 240 may be combined in an array 290 (e.g., two-dimensional array) and operated to form a two-color display device. For example, FIG. 5 illustrates at an array 290 including multiple horizontal rows and vertical columns of light emitting devices 200, wherein the array 290 may be incorporated into a LED display panel. Each light emitting device 200 may include multiple LEDs 205A-205C. Any suitable number of light emitting devices may be used to form an array (e.g. a display panel) of desired size.

FIGS. 6A-6F illustrate exemplary portions of solid state lighting devices in different configurations incorporating electrically activated solid state light emitters arranged over package mounts (or other substrates), with solid state light emitters overlaid with lumiphoric materials and notch filtering materials and optionally overlaid with lenses, wherein such devices may be used alone or in groups according to certain embodiments described herein.

Figure 6A:
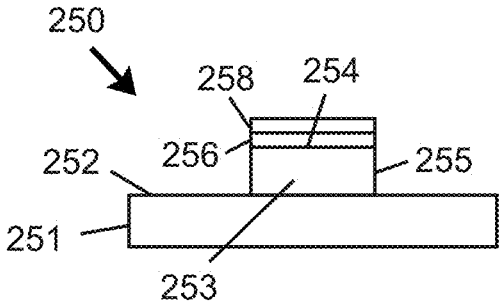
FIG. 6A is a side cross-sectional schematic view of at least a portion of a solid state light emitting device including solid state emitter chips arranged over a package mount, with a top surface of the illustrated emitter chip being covered with a wavelength conversion material and a filtering (e.g., notch filtering) material.

FIG. 6A illustrates a solid state light emitting device 250 including solid state emitter (e.g., LED) chips 253 (which may include LED epitaxial layers and a support) arranged over a top surface 252 of a package mount (or other substrate) 251, with a top surface 254 of the emitter chip 253 being covered with a lumiphoric material 256 (e.g., in a first layer) and a filtering material 258 (e.g., in a second layer). Although only a single LED chip 253 is illustrated, it is to be appreciated that a second LED chip (not shown) may be arranged behind and therefore obscured by the illustrated LED chip 253. The package mount 251 may include metalized regions and/or vias (not shown) for conduction of electrical signals to the emitter chips 253. Side surfaces 255 of the emitter chips 253 may be exposed or otherwise coated with one or more of lumiphoric material and notch filtering material. In certain embodiments, the LED chips 253 may be coated with a lumiphoric material 256 and at least one notch filtering material 258, and thereafter the pre-coated LED chips 253 may be mounted to the package mount 251 followed by establishment of suitable electrically conductive connection(s) to the LED chips 253. Coating may be performed according to any suitable process disclosed herein, such as spray coating.

Figure 6B:
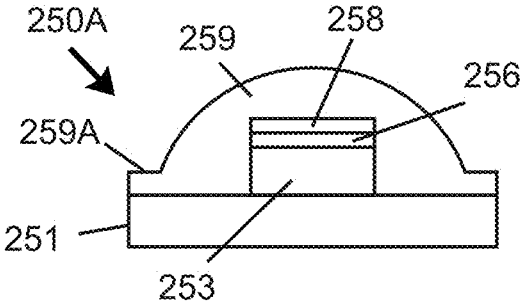
FIG. 6B is a side cross-sectional schematic view of at least a portion of a solid state light emitting device including the device of FIG. 6A with addition of a curved (e.g., hemispherical) lens.

FIG. 6B illustrates a solid state light emitting device 250A including the device 250 of FIG. 6A following addition of a lens 259 having a curved (e.g., substantially hemispherical) shape. Such lens 259 may be formed by any suitable method, including but not limited to molding using silicone material. In certain embodiments, the lens 259 may have a width or lateral extent that is substantially equal to a width or lateral extent of the package mount 251, and a peripheral portion 259A of the lens 259 may have a substantially uniform thickness.

Figure 6C:
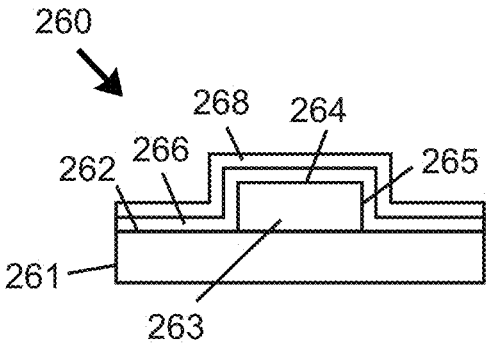
FIG. 6C is a side cross-sectional schematic view of at least a portion of a solid state light emitting device including solid state emitter chips arranged over a package mount, with top and side surfaces of the illustrated emitter chip and an upper surface of the package mount being covered with a wavelength conversion material and a filtering material.

FIG. 6C illustrates a solid state light emitting device 260 including solid state emitter (e.g., LED) chips 265 (which may include LED epitaxial layers and a support) arranged over an upper surface 262 of a package mount (or other substrate) 261, with top surfaces 264 and side surfaces 265 of the emitter chips 263, as well as the upper surface 262 of the package mount 261, being covered with a wavelength conversion (or lumiphoric) material 266 (e.g., in a first layer) and at least one filtering (e.g., notch filtering) material 268 such as in at least one additional layer. In certain embodiments, the LED chips 263 may be mounted to the package mount 261, and thereafter the LED chips 263 and upper surface 262 of the package mount 261 may be coated with a lumiphoric material 266 and one or more notch filtering materials 268. Coating may be performed according to any suitable process disclosed herein, such as spray coating. Such materials 266, 268 may be arranged in conformal layers that follow the shape and outline of multiple surfaces of the emitter chip 263. Electrical connections to the LED chips 263 may be made either before or after coating steps.

Figure 6D:
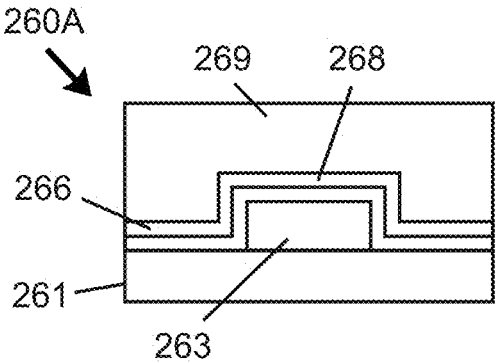
FIG. 6D is a side cross-sectional schematic view of at least a portion of a solid state light emitting device including the device of FIG. 6C with addition of a lens having a substantially rectangular cross-sectional shape.

FIG. 6D illustrates a solid state light emitting device 260A including the device 260 of FIG. 6A following addition of a lens 269 having a substantially rectangular cross-sectional curved (e.g., substantially hemispherical) shape. Such lens 269 may be formed by any suitable method, including but not limited to molding using silicone material. In certain embodiments, the lens 269 may have a width or lateral extent that is substantially equal to a width or lateral extent of the package mount 261.

Figure 6E:
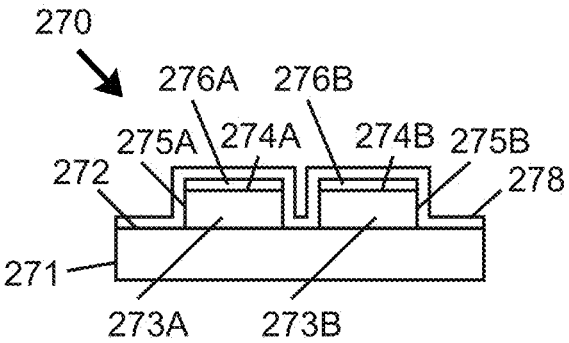
FIG. 6E is a side cross-sectional schematic view of at least a portion of a solid state light emitting device including solid state emitter chips arranged over a package mount, with top surfaces of the illustrated emitter chip being covered with a wavelength conversion material and a filtering material, and with side surfaces of the emitter chips and an upper surface of the package mount being covered with a filtering material.

FIG. 6E illustrates a solid state light emitting device 270 including first and second solid state emitter chips 273A, 273B arranged over a package mount 271, with top surfaces 274A, 274B of the emitter chips 273A, 273B being covered with a wavelength conversion materials 276A, 276B and one or more filtering (e.g., notch filtering) materials 278, and with side surfaces 275A, 275B of the emitter chips 273A, 273B and an upper surface 272 of the package mount 271 being covered with filtering material(s) 278. In certain embodiments, the LED chips 273A, 273B may be pre-coated with the wavelength conversion materials 276A, 276B, then mounted to the package mount 271, and thereafter the pre-coated LED chips 273A, 273B and upper surface 272 of the package mount 271 may be coated with one or more notch filtering materials 278. Coating may be performed according to any suitable process disclosed herein, such as spray coating. The notch filtering material(s) 278 may be arranged in one or more conformal layers that follow the shape and outline of multiple surfaces of the emitter chips 273A, 273B. Electrical connections to the LED chips 273A, 273*b* may be made either before or after a notch filtering material coating step.

Figure 6F:
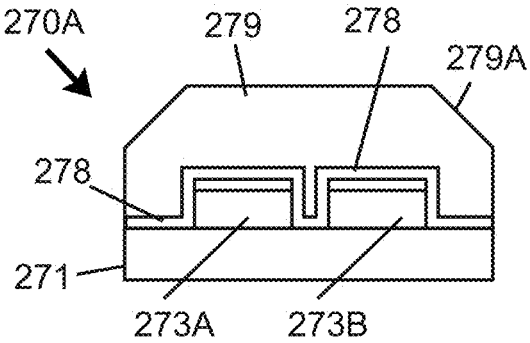
FIG. 6F is a side cross-sectional schematic view of at least a portion of a solid state light emitting device including the device of FIG. 6E with addition of a lens having a beveled upper edge with a non-rectangular (polygonal) cross-sectional shape.

FIG. 6F illustrates a solid state light emitting device 270A including the device 270 of FIG. 6E with addition of a lens 279 having a beveled upper edge 279A with a non-rectangular (polygonal) cross-sectional shape. Such lens 279 may be formed by any suitable method, including but not limited to molding using silicone material. In certain embodiments, the lens 279 may have a width or lateral extent that is substantially equal to a width or lateral extent of the package mount 271.

It is to be appreciated that lenses according to the shapes shown in any of FIGS. 6B, 6D, and 6F may be applied to any of the devices 250, 260, and 270 according to FIGS. 6A, 6C, and 6E.

While not illustrated in FIGS. 6A-6F, one or more boundary walls, dams, or dam portions may be deposited (e.g., dispensed) or otherwise provided on the package mount(s) 251, 261, 271 and laterally spaced relative to the emitter chips to contain one or more layers of material subject to being deposited over the emitter chips. In certain embodiments, emitter chips may be mounted to a package mount, and then one or more layers of functional material (e.g., lumiphoric material and/or notch filtering material) may be deposited to fill portions or an entirety of a volume contained between the boundary wall/dam and the package mount to cover the emitter chips. In certain embodiments, following mounting of one or more emitter chips to a package mount and formation of at least one dam or boundary wall, substantially an entire volume contained by the dam or boundary wall may be filled with a lumiphor-containing material, and optionally planarized and cured, followed by coating or deposition of one or more layers of notch filtering material over the previously-filled volume.

Figure 7:
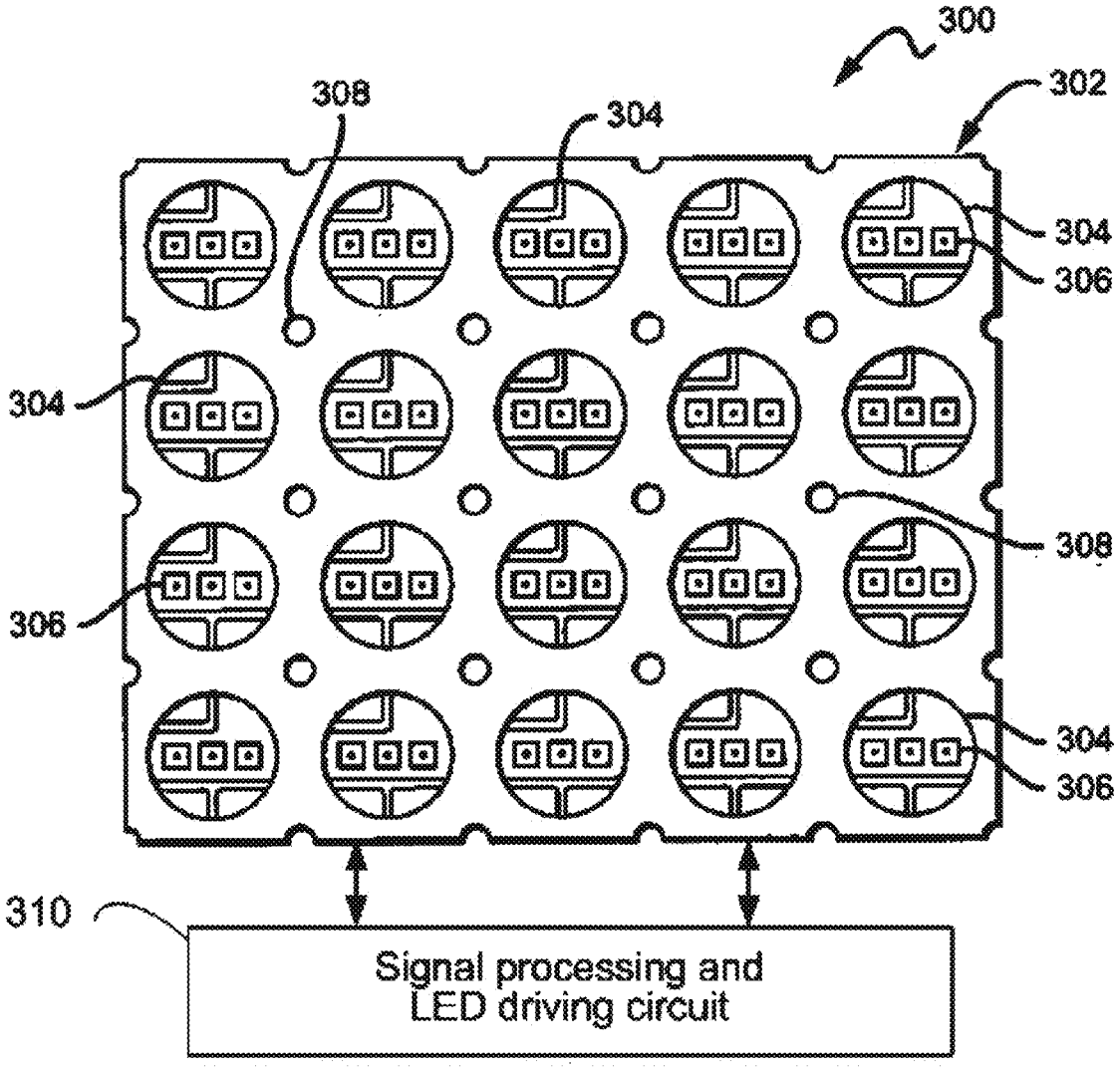
FIG. 7 is a top plan schematic view of at least a portion of a LED display device according to one embodiment.

FIG. 7 illustrates a LED display device or display screen 300, including a driver printed circuit board (PCB) 302 supporting an array of LED devices 304 arranged in rows and columns. The display screen 300 is divided into a plurality of pixels, each having a LED device 304, wherein each LED device 304 includes a substrate supporting multiple LEDs 306. Each display pixel may include a single LED device 304, or may include multiple LED devices 304. LEDs 306 in the same or different LED devices 304 may be individually controlled or controlled as subgroups. In certain embodiments, LED devices 304 may embody or include light emitting devices and/or packages as described herein. The LED devices 304 are electrically connected to metal traces or pads (not shown) on the PCB 302 arranged to connect the LEDs to appropriate electrical signal processing and driver circuitry 310. The signal processing and LED drive circuitry 310 are electrically connected to selectively (e.g., sequentially) energize LEDs 306 in the LED devices 304 for producing visual images on the display to form a multi-color sequentially illuminated display. Holes 308 may be provided between pixels and used to anchor the PCB 302 to one or more mounting platforms.

Figure 8:
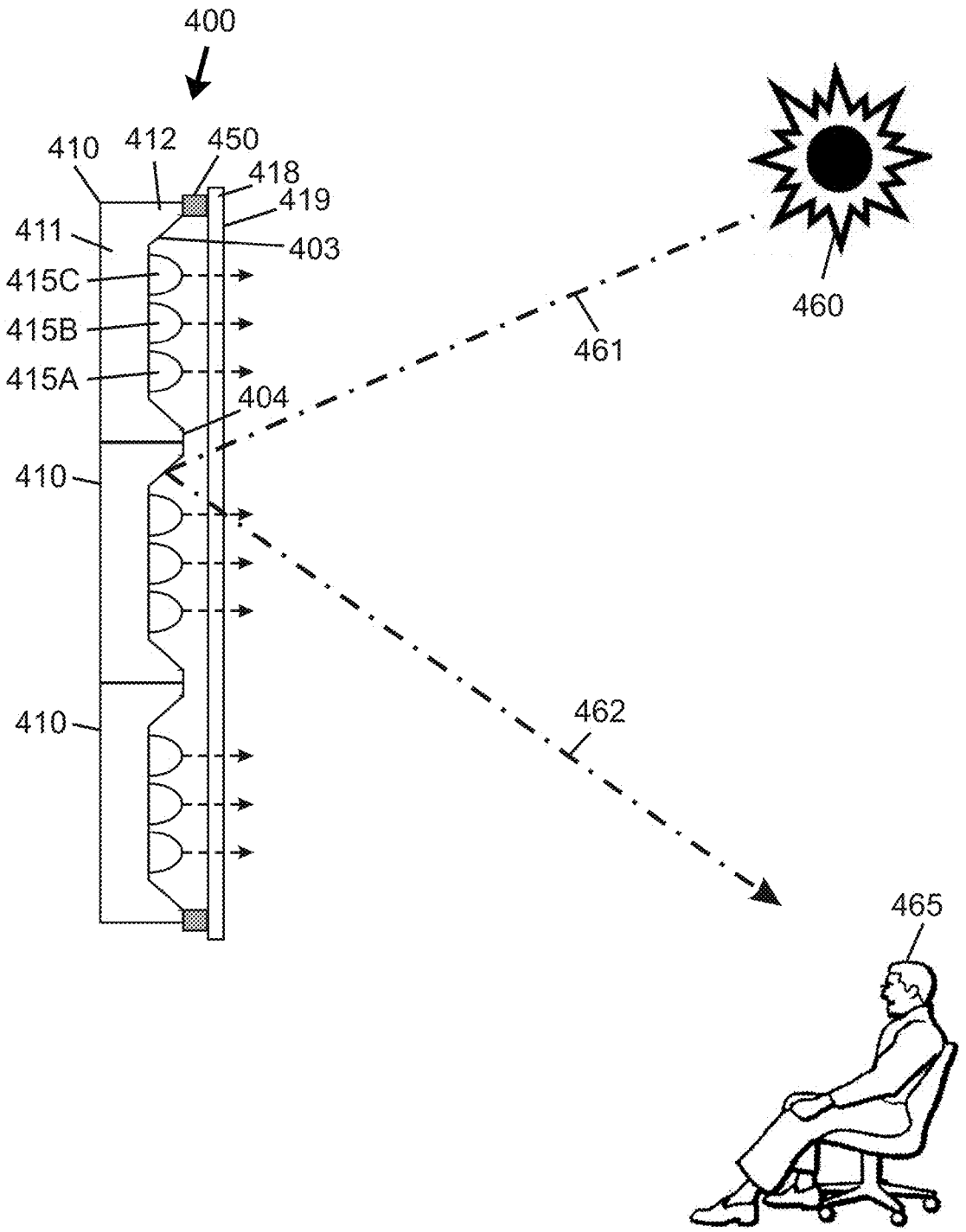
FIG. 8 is a simplified side view of a portion of a LED display device including multiple solid state light emitting devices arranged relative to an ambient light source and a viewer.

FIG. 8 is a simplified side view of a portion of a LED display device 400 including multiple solid state light emitting devices 410 arranged relative to an ambient light source 460 and a viewer 465. Each solid state light emitting device 410 includes multiple emitters 415A-415C arranged in the cavity of a reflector 403 bounded by a substrate or submount 411 and side walls 412. A peripheral region 414 embodying a top surface of the side walls 412 that is peripherally arranged around the reflector 413 may be fabricated of a light absorbing material. At least one filtering material 418 may be arranged in a layer covering all or substantially all of the multiple solid state light emitting devices 410. The at least one filtering material 418 may be spatially segregated from the solid state light emitting devices 410 by one or more spacers 450. The at least one filtering material layer 418 may include multiple filtering materials arranged to separately produce spectral notches. In operation of the display device 400, emitters 415-415C of the multiple solid state light emitting devices 410 are selectively (e.g., sequentially) energized generate light emissions that are transmitted through the at least one filtering material layer 418 to exit a light output surface 419 of the display device 400. The at least one filtering material 418 (which preferably includes multiple filtering materials) is arranged to receive, from an ambient light source 460, at least one incident light beam 461. Following transit in an incoming direction through the at least one filtering material 418, the incident light beam 461 is reflected by the reflector 403 to form a reflected beam 462 that is transmitted in an outgoing direction through the at least one filtering material layer 418. Following transit through the at least one filtering material, the reflected beam exhibits at least one spectral notch. Preferably, the at least one filtering material includes first and second filtering materials arranged to generate first and second spectral notches, and the emitters 415A-415C separately generate first, second, and third dominant wavelengths, wherein the first spectral notch comprises a first wavelength of greatest attenuation in a spectrum between the first dominant wavelength and the second dominant wavelength and the second spectral notch comprises a second wavelength of greatest attenuation in a spectrum between the second dominant wavelength and the third dominant wavelength.

Figure 9:
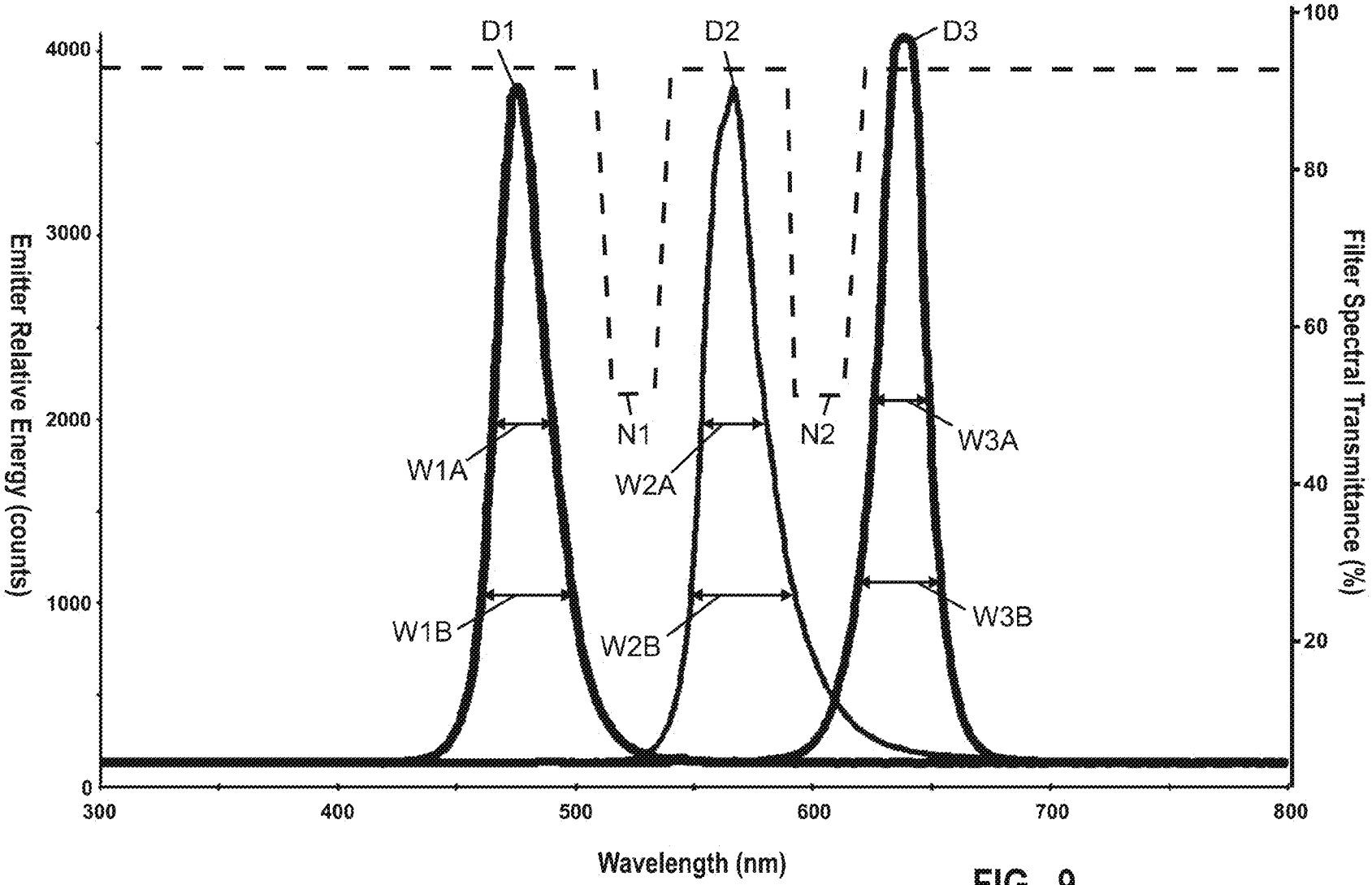
FIG. 9 is an illustrative spectral energy diagram (relative energy versus wavelength) for a hypothetical three-emitter lighting device with two notch filtering materials according to one embodiment, with superimposed spectral transmittance versus wavelength characteristics for two illustrative (e.g., rare earth metal-containing) notch filtering materials

FIG. 9 is an illustrative spectral energy diagram (i.e., relative energy versus wavelength) for a hypothetical three-emitter lighting device with two notch filtering materials according to one embodiment, with superimposed spectral transmittance versus wavelength characteristics for two illustrative (e.g., rare earth metal-containing) notch filtering materials. The first, second, and third emitters provide spectral outputs with dominant wavelengths D1 (~475 nm), D2 (~570) nm), and D3 (~635 nm). The first spectral notch N1 provided by a first filtering material is arranged between the first dominant wavelength D1 and the second dominant wavelength D2, and the second spectral notch N2 provided by a second filtering material is arranged between the second dominant wavelength D3 and the third dominant wavelength D3. The spectrum corresponding to one half maximum output of the first emitter is labeled as W1A, the spectrum corresponding to one fourth maximum output of the first emitter is labeled as W1B, the spectrum corresponding to one half maximum output of the second emitter is labeled as W2A, the spectrum corresponding to one fourth maximum output of the second emitter is labeled as W2A, the spectrum corresponding to one half maximum output of the third emitter is labeled as W3A, and the spectrum corresponding to one fourth maximum output of the third emitter is labeled as W3A. As shown in FIG. 9, the first spectral notch N1 is non-overlapping with the spectra W1A, W1B, W2A, W2B associated with the first and second emitters, and the second spectral notch N2 is non-overlapping with at least the spectra W2A, W3A corresponding to the second and third emitters.

Figure 10:
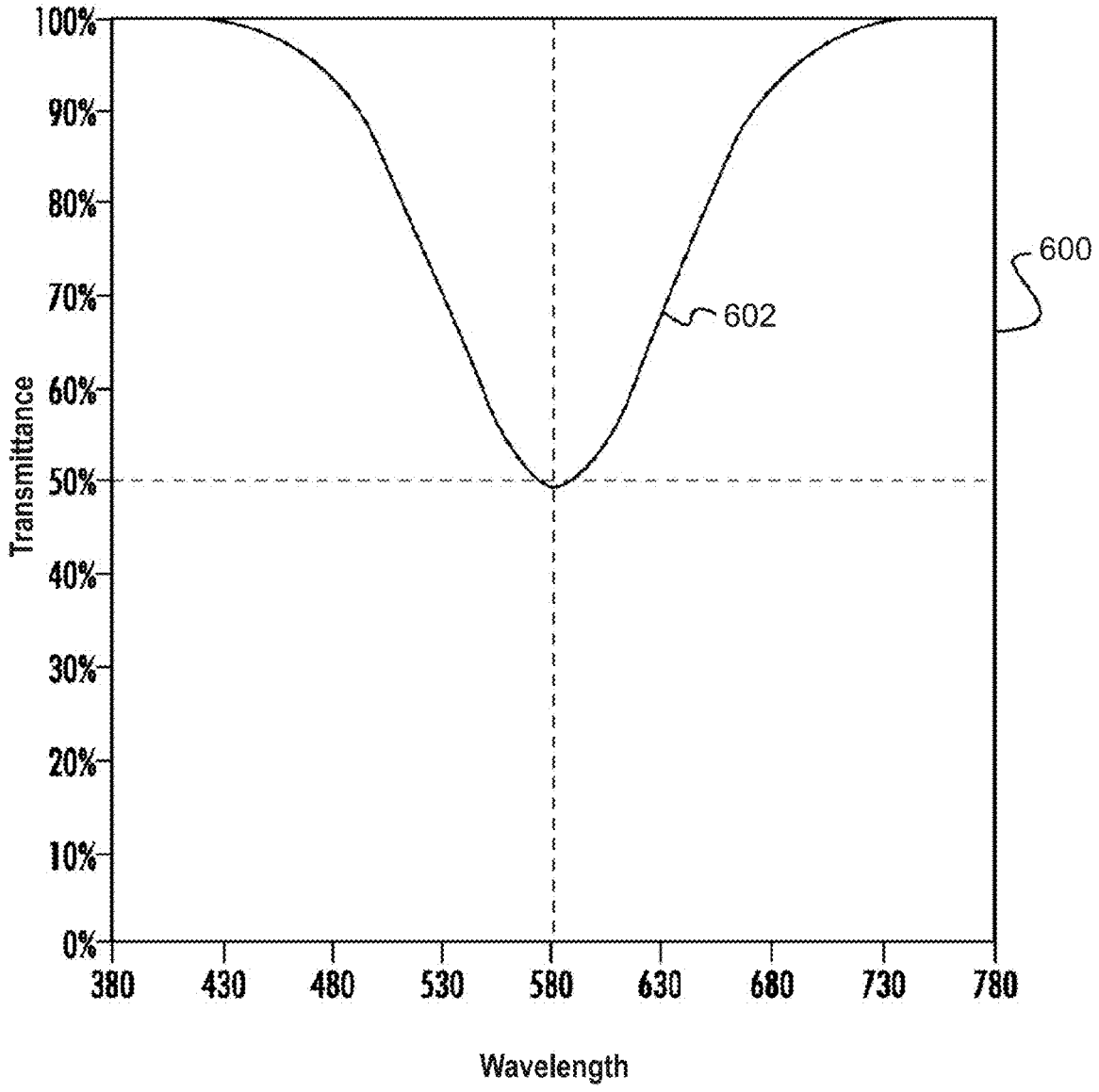
FIG. 10 depicts spectral transmittance versus wavelength for an illustrative color pigment material.

FIG. 10 provides a lie chart 600 illustrating spectral transmittance versus wavelength for an illustrative color pigment material arranged to provide a spectral notch 602 centered at about 580 nm. Transmittance of the color pigment material is nearly 100% at or below wavelengths of about 430 nm, and at or above wavelengths of about 730 nm. Between 430 nm and 730 nm, transmittance is reduced (to a minimum of about 50% at a wavelength of about 580 nm). As shown in FIG. 10, a color pigment may provide a softer spectral notch (with more gradually sloping wavelength attenuation) characteristics relative to other notch filtering materials such as rare earth metals and their oxides, which may exhibit notch shapes more similar to the notches N1, N2 illustrated in FIG. 9.

Embodiments as disclosed herein may provide one or more of the following beneficial technical effects: reduced attenuation of light emitted by solid state light emitting and display devices relative to use of neutral gray filters; enhanced contrast of solid state light emitting and display devices when used in high ambient light conditions; and reduced power consumption and reduced heatsink requirements compared to use of conventional devices that incorporate neutral gray filters.

Those skilled in the art will recognize improvements and modifications to the preferred embodiments of the present disclosure. All such improvements and modifications are considered within the scope of the concepts disclosed herein and the claims that follow. Any of the various features and elements as disclosed herein may be combined with one or more other disclosed features and elements unless indicated to the contrary herein.

What is claimed is:

1. A solid state light emitting device comprising:

a plurality of electrically activated solid state light emitters including at least one first solid state light emitter arranged to generate emissions comprising a first dominant wavelength, and at least one second solid state light emitter arranged to generate emissions comprising a second dominant wavelength; and at least one filtering material arranged in a light path between at least some solid state light emitters of the plurality of electrically activated solid state light emitters and at least one light output surface of the solid state light emitting device, wherein the least one filtering material is arranged to receive ambient light incident on the solid state light emitting device such that at least a portion of reflected ambient light exhibits a first spectral notch, wherein the first spectral notch comprises a wavelength of greatest attenuation between the first dominant wavelength and the second dominant wavelength.

2. The solid state light emitting device of claim 1, wherein a wavelength spectrum corresponding to full width at half maximum (FWHM) attenuation of the first spectral notch is non-overlapping with each of the following spectra:

spectrum corresponding to one-half maximum output of the at least one first solid state light emitter; and spectrum corresponding to one-half maximum output of the at least one second solid state light emitter.

3. The solid state light emitting device of claim 1, wherein the second dominant wavelength exceeds the first dominant wavelength by at least 40 nm.

4. A display device adapted to display at least one of text and visual images, the display device comprising a plurality of solid state light emitting devices according to claim 1.

5. The solid state light emitting device of claim 1, wherein the at least one light output surface of the solid state lighting emitting device comprises the at least one filtering material.

6. A display device adapted to display at least one of text and visual images, the display device comprising:

a plurality of electrically activated solid state light emitters including at least one first solid state light emitter comprising a first dominant wavelength in a range of from 441 nm to 495 nm, at least one second solid state light emitter comprising a second dominant wavelength in a range of from 496 nm to 570 nm, and at least one third solid state light emitter comprising a third dominant wavelength in a range of from 591 nm to 750 nm;

a first filtering material arranged in a light path between at least some solid state light emitters of the plurality of electrically activated solid state light emitters and at least one light output surface of the display device, wherein the first filtering material is arranged to receive ambient light incident on the display device such that at least a portion of reflected ambient light exhibits a first spectral notch, wherein the first spectral notch comprises a first wavelength of greatest attenuation between the first dominant wavelength and the second dominant wavelength; and a second filtering material arranged in a light path between at least some solid state light emitters of the plurality of electrically activated solid state light emitters and at least one light output surface of the display device, wherein the second filtering material is arranged to receive ambient light incident on the display device such that at least a portion of reflected ambient light exhibits a second spectral notch, wherein the second spectral notch comprises a second wavelength of greatest attenuation between the second dominant wavelength and the third dominant wavelength.

7. The display device of claim 6, comprising a multi-color sequentially illuminated LED display device.

8. The display device of claim 6, wherein:

the first filtering material comprises at least one of lanthanum, cerium, praseodymium, neodymium, promethium, samarium, europium, gadolinium, terbium, dysprosium, holmium, erbium, thulium, ytterbium, lutetium, scandium, and yttrium; and the second filtering material comprises at least one of lanthanum, cerium, praseodymium, neodymium, promethium, samarium, europium, gadolinium, terbium, dysprosium, holmium, erbium, thulium, ytterbium, lutetium, scandium, and yttrium.

9. The display device of claim 6, wherein any of the first filtering material and the second filtering material comprises at least one color pigment.

10. The display device of claim 6, further comprising at least one lumiphoric material arranged to receive emissions of at least some emitters of the plurality of electrically activated solid state light emitters and responsively emit lumiphor emissions.

11. The display device of claim 6, further comprising at least one of the following items (a) and (b) arranged in a light path between (i) at least some solid state light emitters of the plurality of electrically activated solid state light emitters and (ii) the at least one light output surface of the display device:

(a) a high pass optical filter arranged to transmit at least some visible light having wavelengths of 420 nm or greater; and (b) a low pass optical filter arranged to transmit at least some visible light having wavelengths of 700 nm or smaller.

12. The display device of claim 6, wherein the at least one light output surface of the display device comprises at least one of the first filtering material and the second filtering material.

13. A solid state light emitting device comprising:

a plurality of electrically activated solid state light emitters including at least one first solid state light emitter arranged to generate emissions comprising a first dominant wavelength, at least one second solid state light emitter arranged to generate emissions comprising a second dominant wavelength, and at least one third solid state light emitter arranged to generate emissions comprising a third dominant wavelength;

a first filtering material arranged in a light path between at least some solid state light emitters of the plurality of electrically activated solid state light emitters and at least one light output surface of the solid state light emitting device, wherein the first filtering material is arranged to receive ambient light incident on the solid state light emitting device such that at least a portion of reflected ambient light exhibits a first spectral notch, wherein the first spectral notch comprises a first wavelength of greatest attenuation between the first dominant wavelength and the second dominant wavelength; and a second filtering material arranged in a light path between at least some solid state light emitters of the plurality of electrically activated solid state light emitters and at least one light output surface of the solid state light emitting device, wherein the second filtering material is arranged to receive ambient light incident on the solid state light emitting device such that at least a portion of reflected ambient light exhibits a second spectral notch, wherein the second spectral notch comprises a second wavelength of greatest attenuation between the second dominant wavelength and the third dominant wavelength.

14. The solid state light emitting device of claim 13, wherein a wavelength spectrum corresponding to full width at half maximum (FWHM) attenuation of the first spectral notch and a wavelength spectrum corresponding to full width at half maximum (FWHM) attenuation of the second spectral notch are non-overlapping with each of the following spectra:

spectrum corresponding to one-half maximum output of the at least one first solid state light emitter;

spectrum corresponding to one-half maximum output of the at least one second solid state light emitter; and spectrum corresponding to one-half maximum output of the at least one third solid state light emitter.

15. The solid state light emitting device of claim 13, wherein the second dominant wavelength exceeds the first dominant wavelength by at least 40 nm, and wherein the third dominant wavelength exceeds the second dominant wavelength by at least 50 nm.

16. The solid state light emitting device of claim 13, wherein:

the first filtering material comprises at least one of lanthanum, cerium, praseodymium, neodymium, promethium, samarium, europium, gadolinium, terbium, dysprosium, holmium, erbium, thulium, ytterbium, lutetium, scandium, and yttrium; and the second filtering material comprises at least one of lanthanum, cerium, praseodymium, neodymium, promethium, samarium, europium, gadolinium, terbium, dysprosium, holmium, erbium, thulium, ytterbium, lutetium, scandium, and yttrium.

17. The solid state light emitting device of claim 13, wherein any of the first filtering material and the second filtering material comprises at least one color pigment.

18. The solid state light emitting device of claim 13, wherein the first filtering material and the second filtering material are coated on at least some emitters of the plurality of electrically activated solid state light emitters.

19. The solid state light emitting device of claim 13, wherein at least one of the first filtering material and the second filtering material is arranged in a carrier disposed on or over the plurality of electrically activated solid state light emitters.

20. The solid state light emitting device of claim 13, further comprising at least one of the following items (a) and (b) arranged in a light path between (i) at least some solid state light emitters of the plurality of electrically activated solid state light emitters and (ii) the at least one light output surface of the solid state light emitting device:

(a) a high pass optical filter arranged to transmit at least some visible light having wavelengths of 420 nm or greater; and (b) a low pass optical filter arranged to transmit at least some visible light having wavelengths of 700 nm or smaller.

21. A display device adapted to display at least one of text and visual images, the display device comprising a plurality of solid state light emitting devices according to claim 13.

22. The solid state light emitting device of claim 13, wherein the at least one light output surface of the solid state light emitting device comprises at least one of the first filtering material and the second filtering material.

23. A display device adapted to display at least one of text and visual images, the display device comprising:

a plurality of electrically activated solid state light emitters including a first group of solid state emitters arranged to generate emissions having a first dominant wavelength and a second group of solid state emitters arranged to generate emissions having a second dominant wavelength that differs from the first dominant wavelength by at least 50 nm; and at least one filtering material arranged in a light path between (i) at least some solid state light emitters of the plurality of electrically activated solid state light emitters and (ii) at least one light output surface of the display device, wherein the at least one filtering material is arranged to receive ambient light incident on the display device such that at least a portion of reflected ambient light exiting the display device exhibits a first spectral notch, wherein the first spectral notch comprises a wavelength of greatest attenuation between the first dominant wavelength and the second dominant wavelength.

24. The display device of claim 23, wherein a wavelength spectrum corresponding to full width at half maximum (FWHM) attenuation of the first spectral notch is non-overlapping with each of the following spectra:

spectrum corresponding to one-half maximum output of the first group of solid state emitters; and spectrum corresponding to one-half maximum output of the second group of solid state emitters.

25. The display device of claim 23, comprising a multicolor sequentially illuminated LED display device.

26. The display device of claim 23, wherein the at least one filtering material comprises at least one of lanthanum, cerium, praseodymium, neodymium, promethium, samarium, europium, gadolinium, terbium, dysprosium, holmium, erbium, thulium, ytterbium, lutetium, scandium, and yttrium.

27. The display device of claim 23, wherein the at least one filtering material comprises at least one color pigment.

28. The display device of claim 23, wherein the plurality of electrically activated solid state light emitters includes an array of electrically activated solid state light emitters arranged in multiple vertical columns and multiple horizontal rows.

29. The display device of claim 23, wherein the at least one filtering material is conformally coated on the plurality of electrically activated solid state light emitters.

30. The display device of claim 23, wherein the at least one filtering material is arranged in or on a carrier arranged on or over the plurality of electrically activated solid state light emitters.

31. The display device of claim 23, wherein the plurality of electrically activated solid state light emitters are arranged in a plurality of clusters, and wherein each cluster of the plurality of clusters includes at least one emitter of the first group of solid state light emitters and at least one emitter of the second group of solid state light emitters.

32. The display device of claim 23, further comprising at least one lumiphoric material arranged to receive emissions of at least some emitters of the plurality of electrically activated solid state light emitters and responsively emit lumiphor emissions.

33. The display device of claim 23, wherein the plurality of electrically activated solid state emitters are arranged in a plurality of solid state light emitter packages, and wherein each solid state light emitter package of the plurality of solid state light emitter packages includes at least one emitter of the first group and the second group of solid state emitters.

34. The display device of claim 23, wherein the at least one filtering material is arranged to receive ambient light incident on the display device such that at least a portion of reflected ambient light exiting the display device exhibits a second spectral notch, wherein the second spectral notch is non-coincident with the first spectral notch.

35. The display device of claim 23, wherein:

the plurality of electrically activated solid state light emitters further includes a third group of solid state emitters arranged to generate emissions having a third dominant wavelength that differs from the first dominant wavelength by at least 100 nm and differs from the second dominant wavelength by at least 50 nm; and the at least one filtering material includes at least one other notch filtering material arranged to receive ambient light incident on the display device such that at least a portion of reflected ambient light exiting the display device exhibits a second spectral notch, wherein the second spectral notch comprises a wavelength of greatest attenuation between the second dominant wavelength and the third dominant wavelength.

36. The display device of claim 23, further comprising at least one of the following items (a) and (b) arranged in a light path between (i) at least some solid state light emitters of the plurality of electrically activated solid state light emitters and (ii) the at least one light output surface of the display device:

(a) a high pass optical filter arranged to transmit at least some visible light having wavelengths of 420 nm or greater; and (b) a low pass optical filter arranged to transmit at least some visible light having wavelengths of 700 nm or smaller.

37. The display device of claim 23, wherein the at least one light output surface of the display device comprises the at least one filtering material.

* * * * *